US008506127B2

(12) United States Patent
Russello et al.

(10) Patent No.: US 8,506,127 B2
(45) Date of Patent: Aug. 13, 2013

(54) LENS FRAME WITH A LED SUPPORT SURFACE AND HEAT DISSIPATING STRUCTURE

(75) Inventors: Thomas Russello, Freehold, NJ (US); Dylan Akinrele, Leonia, NJ (US); Kevin Anthony Baboolal, Brooklyn, NY (US); Gary Eugene Schaefer, Kitchener (CA); Dana Wallace, Tupelo, MS (US); Wayne D. Campbell, Kitchener (CA); Clint Stanford, Pontotoc, MS (US); Hristea Mihalcea, Kitchener (CA)

(73) Assignee: Koninklijke Philips N.V., Eindhoven (NL)

( * ) Notice: Subject to any disclaimer, the term of this patent is extended or adjusted under 35 U.S.C. 154(b) by 504 days.

(21) Appl. No.: 12/636,243

(22) Filed: Dec. 11, 2009

(65) Prior Publication Data

US 2011/0141728 A1 Jun. 16, 2011

(51) Int. Cl.
*F21V 21/00* (2006.01)
*F21V 15/00* (2006.01)

(52) U.S. Cl.
USPC ..... 362/294; 362/235; 362/362; 362/364; 362/373; 362/374

(58) Field of Classification Search
USPC ..... 362/235, 294, 373
See application file for complete search history.

(56) References Cited

U.S. PATENT DOCUMENTS

| | | | | |
|---|---|---|---|---|
| 492,320 | A | 2/1893 | Bodkin | |
| 1,484,978 | A | 2/1924 | Wheeler | |
| 1,652,347 | A | 12/1927 | Champeau | |
| 1,900,539 | A * | 3/1933 | Brady | 362/294 |
| 2,428,630 | A | 10/1947 | Lanter | |
| 2,456,179 | A | 12/1948 | Finer | |
| 3,094,220 | A | 6/1963 | Harling | |
| 3,193,001 | A | 7/1965 | Meckler | |
| 3,311,743 | A | 3/1967 | Moore | |
| 3,372,740 | A | 3/1968 | Kastovich et al. | |
| 3,533,062 | A | 10/1970 | Coffman | |
| 3,643,079 | A | 2/1972 | Glickman | |
| 3,752,974 | A | 8/1973 | Baker et al. | |
| 3,797,914 | A | 3/1974 | Aiken | |
| 3,798,436 | A | 3/1974 | Gross | |
| 3,801,815 | A | 4/1974 | Docimo | |
| 3,845,292 | A | 10/1974 | Koziol | |
| 3,890,126 | A | 6/1975 | Joseph | |
| 4,025,777 | A | 5/1977 | Hayakawa | |
| 4,081,023 | A | 3/1978 | Edelstein et al. | |
| 4,225,808 | A | 9/1980 | Saraceni | |

(Continued)

FOREIGN PATENT DOCUMENTS

JP 2006172895 6/2006

*Primary Examiner* — Sikha Roy

(57) ABSTRACT

A lens frame for mounting and cooling LEDs is described. The lens frame (120) may be continuous and attachable to a luminaire (100) having a luminaire housing (110) with an opening (112). The lens frame (120) may extend across and close the opening (112) of the luminaire housing (110). The lens frame (120) may include a recessed support surface (122), a lens attachment area (126) positioned outward from and peripherally of the support surface (122), and heat dissipating structure (130) located peripherally of the support surface (122). A plurality of LEDs (154) may be coupled to the support surface (122) of the lens frame (120) exteriorly of the luminaire housing (110) and a lens (188) may be coupled to the lens retaining area (126) of the lens frame (120).

19 Claims, 16 Drawing Sheets

(56) References Cited

U.S. PATENT DOCUMENTS 4,321,656 A 3/1982 Gruver, Jr.
4,433,328 A 2/1984 Saphir et al.
4,448,005 A 5/1984 Vochelli
4,499,529 A 2/1985 Figueroa
4,503,360 A 3/1985 Bedel
4,504,894 A 3/1985 Reibling
4,509,106 A 4/1985 Meyer et al.
4,654,629 A 3/1987 Bezos et al.
4,729,076 A 3/1988 Masami et al.
4,734,835 A 3/1988 Vines et al.
4,871,944 A 10/1989 Skwirut et al.
4,943,900 A 7/1990 Gartner
4,954,822 A 9/1990 Borenstein
4,982,176 A 1/1991 Schwarz
4,987,523 A 1/1991 Lindabury et al.
4,999,749 A 3/1991 Dormand
5,010,452 A 4/1991 Krebser et al.
5,075,833 A 12/1991 Dormand
5,136,287 A 8/1992 Borenstein
5,138,541 A 8/1992 Kano
5,142,460 A 8/1992 McAtee
5,154,509 A 10/1992 Wulfman et al.
5,351,172 A 9/1994 Attree et al.
5,375,043 A 12/1994 Tokunaga
5,388,357 A 2/1995 Malita
5,390,092 A 2/1995 Lin
5,426,574 A 6/1995 Carolfi
5,450,302 A 9/1995 Maase et al.
5,463,280 A 10/1995 Johnson
5,537,301 A 7/1996 Martich
5,548,499 A 8/1996 Zadeh
5,575,459 A 11/1996 Anderson
5,580,163 A 12/1996 Johnson, II
5,607,227 A 3/1997 Yasumoto et al.
5,655,830 A 8/1997 Ruskouski
5,688,042 A 11/1997 Madadi et al.
5,726,535 A 3/1998 Yan
5,752,766 A 5/1998 Bailey et al.
5,785,411 A 7/1998 Komai et al.
5,785,418 A 7/1998 Hochstein
5,790,040 A 8/1998 Kreier et al.
5,806,965 A 9/1998 Deese
5,810,463 A 9/1998 Kawahara et al.
5,890,794 A 4/1999 Abtahi et al.
5,918,970 A 7/1999 Brohard et al.
5,949,347 A 9/1999 Wu
5,980,071 A 11/1999 Hsieh
5,993,027 A 11/1999 Yamamoto et al.
6,045,240 A 4/2000 Hochstein
6,068,383 A 5/2000 Robertson et al.
6,068,384 A 5/2000 Tyson et al.
6,154,362 A 11/2000 Takahashi et al.
6,166,640 A 12/2000 Nishihira et al.
6,183,114 B1 2/2001 Cook et al.
6,193,603 B1 2/2001 Tai
6,208,466 B1 3/2001 Liu et al.
6,220,722 B1 4/2001 Begemann
6,250,774 B1 6/2001 Begemann et al.
6,271,532 B1 8/2001 Trokhan et al.
6,276,814 B1 8/2001 Gough
6,305,109 B1 10/2001 Lee
6,325,651 B1 12/2001 Nishihara et al.
6,331,915 B1 12/2001 Myers
6,341,877 B1 1/2002 Chong
6,350,043 B1 2/2002 Gloisten
6,350,046 B1 2/2002 Lau
6,357,893 B1 3/2002 Belliveau
6,367,949 B1 4/2002 Pederson
6,379,024 B1 4/2002 Kogure et al.
6,388,393 B1 5/2002 Illingworth
6,392,541 B1 5/2002 Bucher et al.
6,394,626 B1 5/2002 McColloch
6,402,346 B1 6/2002 Liao et al.
6,431,728 B1 8/2002 Fredericks et al.
6,502,962 B1 1/2003 Menke et al.
6,517,222 B1 2/2003 Orlov
6,520,655 B2 2/2003 Ohuchi
6,540,372 B2 4/2003 Joseph
6,573,536 B1 6/2003 Dry
6,577,072 B2 6/2003 Saito et al.
6,583,550 B2 6/2003 Iwasa et al.
6,585,395 B2 7/2003 Luk
6,628,352 B1 9/2003 Sumida et al.
6,632,006 B1 10/2003 Rippel et al.
6,666,567 B1 12/2003 Feldman et al.
6,678,168 B2 1/2004 Kenny, Jr. et al.
6,703,795 B2 3/2004 Johnson
6,705,751 B1 3/2004 Liu
6,739,734 B1 5/2004 Hulgan
6,762,562 B2 7/2004 Leong
6,815,724 B2 11/2004 Dry
6,853,151 B2 2/2005 Leong et al.
6,860,628 B2 3/2005 Robertson et al.
6,871,983 B2 3/2005 Jacob et al.
6,905,227 B2 6/2005 Wu
6,927,541 B2 8/2005 Lee
6,932,495 B2 8/2005 Sloan et al.
6,936,968 B2 8/2005 Cross et al.
6,942,361 B1 9/2005 Kishimura et al.
6,943,687 B2 9/2005 Lee et al.
6,948,829 B2 * 9/2005 Verdes et al. ..... 362/227
6,948,840 B2 9/2005 Grenda et al.
6,955,440 B2 10/2005 Niskamen
6,974,233 B1 12/2005 Aubrey
6,979,105 B2 12/2005 Leysath
6,994,452 B2 2/2006 Rozenberg et al.
6,997,583 B2 2/2006 Broelemann
7,014,341 B2 3/2006 King et al.
7,021,787 B1 4/2006 Kuelbs
7,034,470 B2 4/2006 Cok et al.
7,049,761 B2 5/2006 Timmermans et al.
7,053,557 B2 5/2006 Cross et al.
7,067,992 B2 6/2006 Leong et al.
7,086,747 B2 8/2006 Nielson et al.
7,098,486 B2 8/2006 Chen
7,101,056 B2 9/2006 Pare
7,114,830 B2 10/2006 Robertson et al.
7,132,785 B2 11/2006 Ducharme
7,137,727 B2 11/2006 Joseph et al.
7,140,753 B2 11/2006 Wang et al.
7,178,952 B2 2/2007 Bucher et al.
7,182,547 B1 2/2007 Leonhardt et al.
7,186,002 B2 3/2007 Matthews et al.
7,192,160 B2 3/2007 Reiff, Jr. et al.
7,195,367 B2 3/2007 Hong et al.
7,198,384 B2 4/2007 Kakiuchi et al.
7,207,690 B2 4/2007 Haugaard et al.
7,218,056 B1 5/2007 Harwood
7,241,038 B2 7/2007 Naniwa et al.
7,249,865 B2 7/2007 Robertson
7,252,409 B2 8/2007 Kim
7,255,460 B2 8/2007 Lee
7,307,546 B1 12/2007 Partap
7,329,031 B2 2/2008 Liaw et al.
7,438,441 B2 10/2008 Sun et al.
7,440,280 B2 10/2008 Shuy
7,524,089 B2 4/2009 Park
7,593,229 B2 9/2009 Shuy
7,631,993 B2 * 12/2009 Russello et al. ..... 362/374
2001/0012205 A1 8/2001 Lassovsky
2002/0047516 A1 4/2002 Iwasa et al.
2002/0122309 A1 9/2002 Abdelhafez et al.
2002/0136010 A1 9/2002 Luk
2002/0145878 A1 10/2002 Venegas, Jr.
2002/0176259 A1 11/2002 Ducharme
2002/0181231 A1 12/2002 Luk
2003/0021117 A1 1/2003 Chan
2003/0052599 A1 3/2003 Sun
2003/0102810 A1 6/2003 Cross et al.
2003/0137845 A1 7/2003 Leysath
2004/0007980 A1 1/2004 Shibata
2004/0062041 A1 4/2004 Cross et al.
2004/0080960 A1 4/2004 Wu
2004/0095078 A1 5/2004 Leong 2004/0107615 A1 6/2004 Pare
2004/0109330 A1 6/2004 Pare
2004/0120152 A1 6/2004 Bolta et al.
2004/0141326 A1 7/2004 Dry
2004/0189218 A1 9/2004 Leong et al.
2005/0007024 A1 1/2005 Evans et al.
2005/0030761 A1 2/2005 Burgess
2005/0036322 A1 2/2005 Veffer
2005/0041424 A1 2/2005 Ducharme
2005/0073760 A1 4/2005 Kakiuchi et al.
2005/0078477 A1 4/2005 Lo
2005/0104946 A1 5/2005 Siegel
2005/0122229 A1 6/2005 Stevenson et al.
2005/0146899 A1 7/2005 Joseph et al.
2005/0162101 A1 7/2005 Leong et al.
2005/0168986 A1 8/2005 Wegner
2005/0169015 A1 8/2005 Luk et al.
2005/0190567 A1 9/2005 Childers et al.
2005/0201082 A1 9/2005 Mauk et al.
2005/0207168 A1 9/2005 Chabert
2005/0212397 A1 9/2005 Murazaki et al.
2005/0265023 A1 12/2005 Scholl
2005/0276053 A1 12/2005 Nortrup et al.
2005/0281030 A1 12/2005 Leong et al.
2006/0002106 A1 1/2006 Hong et al.
2006/0007682 A1 1/2006 Reiff, Jr. et al.
2006/0050528 A1 3/2006 Lyons et al.
2006/0092638 A1 5/2006 Harwood
2006/0109661 A1 5/2006 Coushaine et al.
2006/0164843 A1 7/2006 Adachi et al.
2006/0193139 A1 8/2006 Sun et al.
2006/0209545 A1 9/2006 Yu
2006/0215408 A1* 9/2006 Lee ..... 362/294
2006/0221606 A1 10/2006 Dowling
2006/0262545 A1 11/2006 Piepgras et al.
2006/0285325 A1 12/2006 Ducharme et al.
2006/0291202 A1 12/2006 Kim
2007/0021147 A1 1/2007 McCann
2007/0030686 A1 2/2007 Haugaard et al.
2007/0053182 A1 3/2007 Robertson
2007/0058358 A1 3/2007 Chikazawa et al.
2007/0076416 A1 4/2007 Leonhardt et al.
2007/0102033 A1 5/2007 Petrocy
2007/0114558 A1 5/2007 Lam
2007/0115654 A1 5/2007 Ruben
2007/0120135 A1 5/2007 Soules et al.
2007/0133202 A1 6/2007 Huang et al.
2007/0183156 A1 8/2007 Shan
2007/0211470 A1 9/2007 Huang
2007/0230172 A1 10/2007 Wang
2007/0230183 A1 10/2007 Shuy
2007/0230184 A1 10/2007 Shuy
2007/0247853 A1 10/2007 Dorogi
2007/0279909 A1 12/2007 Li
2007/0285949 A1 12/2007 Lodhie et al.
2008/0007955 A1 1/2008 Li
2008/0043472 A1 2/2008 Wang
2008/0074869 A1 3/2008 Okishima
2008/0080188 A1 4/2008 Wang
2008/0084701 A1 4/2008 Van De Ven et al.
2008/0158887 A1 7/2008 Zhu et al.
2008/0165535 A1 7/2008 Mazzochette
2008/0184475 A1 8/2008 Sladick et al.
2008/0205062 A1 8/2008 Dahm et al.
2008/0212333 A1 9/2008 Chen
2008/0253124 A1 10/2008 Liao
2008/0266866 A1* 10/2008 Tsai ..... 362/294
2008/0304269 A1 12/2008 Pickard et al.
2009/0040750 A1 2/2009 Myer
2009/0072970 A1 3/2009 Barton
2009/0080189 A1 3/2009 Wegner
2009/0086476 A1 4/2009 Wegner et al.
2009/0086481 A1 4/2009 Wegner

* cited by examiner

LENS FRAME WITH A LED SUPPORT SURFACE AND HEAT DISSIPATING STRUCTURE

CROSS-REFERENCE TO RELATED DOCUMENTS

Not Applicable.

TECHNICAL FIELD

This invention pertains to a luminaire having a lens frame with a light emitting diode support surface and heat dissipating structure.

BACKGROUND

Luminaires used for area or outdoor lighting may include a housing that surrounds a light source such as a Metal Halide or High Pressure Sodium HID lamp. A lens frame may comprise part of or be coupled to the housing and may secure and support a lens. Together, the housing, lens frame, and lens may enclose the light source. The lens provides a transparent or translucent passageway for light from the light source within the housing to exit the housing and illuminate a desired area. The lens and/or lens frame may be adjustably or removably coupled to the housing so as to enable a user access to the interior of the housing for light source replacement, maintenance, or other purposes.

BRIEF DESCRIPTION OF THE ILLUSTRATIONS

Embodiments of the invention are illustrated in the following Figures.

SUMMARY

Figure 1:
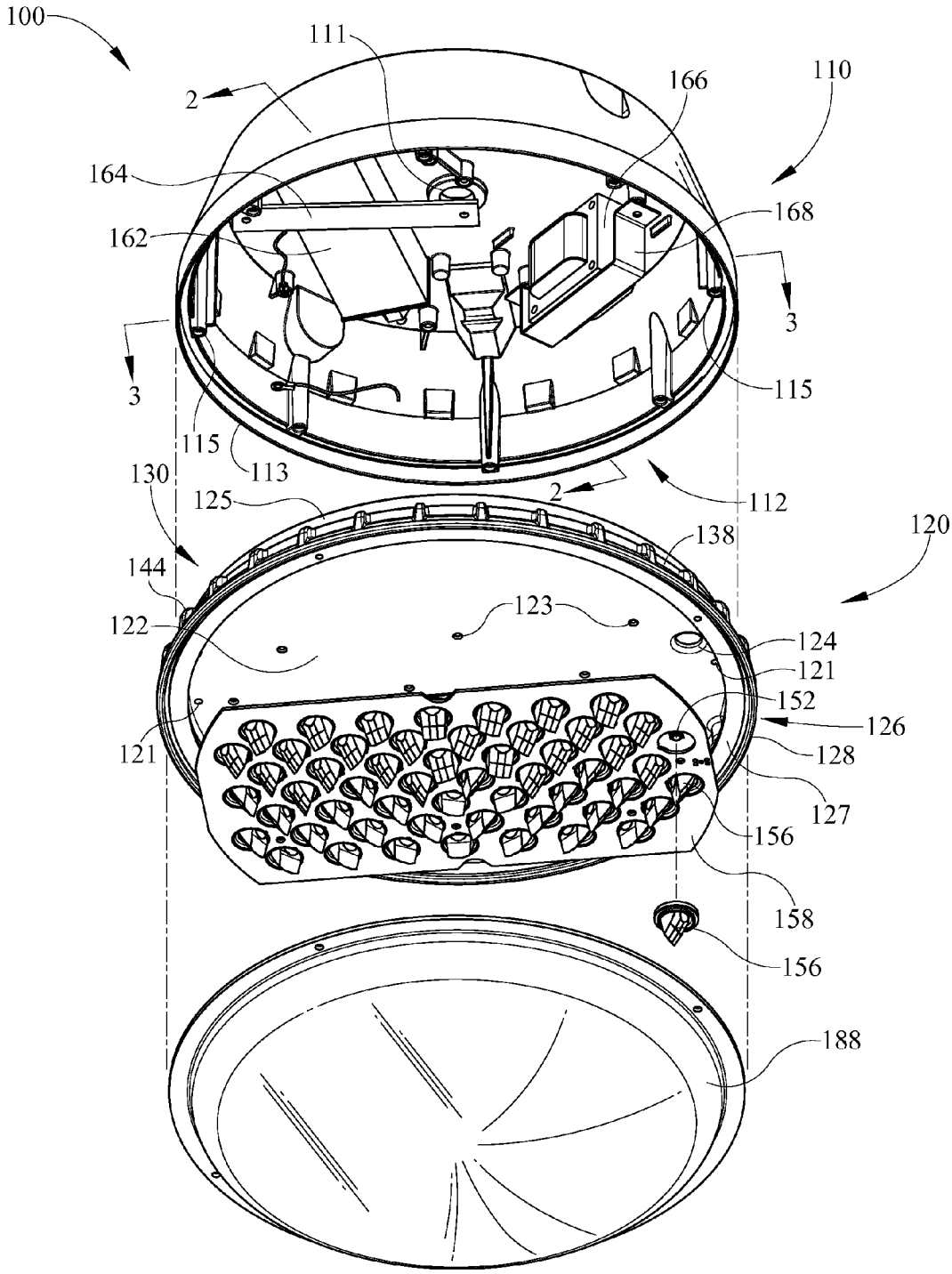
FIG. 1 is a bottom exploded perspective view of a first embodiment of a luminaire having a lens frame with a LED support surface and heat dissipating structure.

A lens frame for mounting and cooling LEDs is described herein. The lens frame includes a light emitting diode support surface and heat dissipating structure. The lens frame is of a sufficient mass to provide appropriate cooling of LEDs that may be mounted thereon. The lens frame may be continuous and attachable to a luminaire having a luminaire housing with an opening.

Generally, in one aspect, a retrofit heat dissipating lens frame for attachment to a luminaire housing having a luminaire housing opening is provided. The heat dissipating lens frame comprises a continuous support surface supporting an LED board having a plurality of LEDs coupled thereto. The continuous support surface generally faces an illumination direction. The heat dissipating lens frame further comprises heat dissipating structure integrally formed with the support surface. The heat dissipating structure is provided peripherally of the support surface and extends away from the support surface generally in the illumination direction. The heat dissipating lens frame further comprises a lens attachment flange integrally formed with the heat dissipating structure and offset away from the support surface generally in the illumination direction. A lens may be attached to the lens attachment flange. The lens, the support surface, and the heat dissipating structure form a substantially sealed chamber for the plurality of LEDs. The support surface is of a sufficient mass to thermally transfer heat from the LED board outwardly to the heat dissipating structure. The heat dissipating lens frame is sized to completely cover the opening of the housing when attached to the housing. The heat dissipating structure is at least partially directly exposed to the external environment when the lens frame is attached to the luminaire housing.

In some embodiments the heat dissipating structure includes a plurality of heat fins located peripherally of the LED support surface. In versions of the embodiments the plurality of heat fins are located peripherally of the luminaire housing when the lens frame is attached to the luminaire housing. In versions of the embodiments the plurality of heat fins are vertically oriented and extend from adjacent a support surface plane generally defined by the support surface to adjacent a lens attachment plane generally defined by the lens attachment lip.

In some embodiments the heat dissipating structure includes a vertically oriented sidewall extending between the LED support surface and the lens.

In some embodiments the heat dissipating structure includes a sidewall extending between the LED support surface and the lens. In versions of the embodiments the heat dissipating structure includes at least one trough between the sidewall and the periphery of the heat dissipating lens frame. In versions of the embodiments the at least one trough is generally upward facing and is not directly exposed to the external environment when the lens frame is attached to the luminaire housing. In versions of the embodiments the at least one trough is generally facing in the illumination direction and is directly exposed to the external environment when the lens frame is attached to the luminaire housing.

Generally, in another aspect, a luminaire with a lens frame for mounting and cooling LEDs is provided. The luminaire comprises a luminaire housing having an opening. The luminaire further comprises a continuous lens frame extending across and closing the opening of the luminaire housing. The lens frame comprises a recessed support surface, a lens attachment area positioned peripherally of the support surface and outward and away from the support surface and the luminaire housing, and heat dissipating structure located peripherally of the support surface. The luminaire further comprises a plurality of LEDs coupled to the support surface of the lens frame exteriorly of the luminaire housing and a lens coupled to the lens retaining area. The support surface, the heat dissipating structure, and the lens enclose the LEDs and an LED driver is located interiorly of the housing remote from the lens frame.

In some embodiments the heat dissipating structure includes a plurality of vertically oriented heat fins extending from adjacent a support surface plane generally defined by the support surface to adjacent a lens attachment plane generally defined by the lens attachment lip. In versions of the embodiments the heat fins extend peripherally of the luminaire housing. In versions of the embodiments the heat fins are flanked by sidewalls of the heat dissipating structure. In versions of the embodiments the sidewalls include at least a portion of a vertically oriented sidewall extending between the LED support surface and the lens.

In some embodiments the heat dissipating structure includes at least one trough between the support surface and the periphery of the heat dissipating lens frame. In versions of the embodiments the at least one trough is located interiorly of the luminaire. In versions of the embodiments the at least one trough is generally facing away from the luminaire housing and exposed to the external environment.

Generally, in another aspect, an LED luminaire comprises a housing having an opening. The LED luminaire further comprises an LED driver surrounded by the housing. The LED luminaire further comprises a lens frame contacting the housing and extending completely across the opening of the housing. The lens frame having a support surface, a lens retaining area positioned outward and away from the support surface, and heat dissipating structure located peripherally of the support surface and connecting the support surface and the lens retaining area. The lens retaining lip, the support surface, and the heat dissipating structure are all formed as an integral piece. The LED luminaire further comprises an LED board coupled to the support surface. The LED board has a plurality of LEDs outputting a directed light output and electrically connected to the LED driver. The LED luminaire further comprises a lens coupled to the lens retaining area. The lens, the LED support surface, and the heat dissipating structure form a chamber enclosing the plurality of LEDs. The LED driver is mounted within the housing non-adjacent to the lens frame.

In some embodiments the heat dissipating structure includes at least one vertically oriented wall extending from a periphery of the support surface toward the lens retaining lip. In versions of the embodiments the lens retaining ring couples the lens to the lens retaining lip.

In some embodiments the heat dissipating structure includes a plurality of vertically oriented heat fins extending from adjacent a support surface plane generally defined by the support surface to adjacent a lens attachment plane generally defined by the lens attachment lip. In versions of the embodiments the heat fins extend peripherally of the luminaire housing. In versions of the embodiments the heat fins are flanked by sidewalls of the heat dissipating structure. In versions of the embodiments, the sidewalls include at least a portion of a vertically oriented interior sidewall extending between the LED support surface and the lens. In versions of the embodiments the sidewalls include at least a portion of a vertically oriented interior sidewall extending between the LED support surface and the lens. In versions of the embodiments the sidewalls include at least a portion of a vertically oriented exterior sidewall located peripherally of the interior sidewall and directly exposed to the external environment.

In some embodiments the heat dissipating structure includes at least one trough between the support surface and the periphery of the heat dissipating lens frame, the trough being exposed to the external environment.

In some embodiments the housing is a downlight housing. In versions of the embodiments the operating temperature of the heat dissipating lens frame is greater than the operating temperature of the housing, thereby preventing icicle build up on the heat dissipating lens frame.

DETAILED DESCRIPTION

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Figure 2:
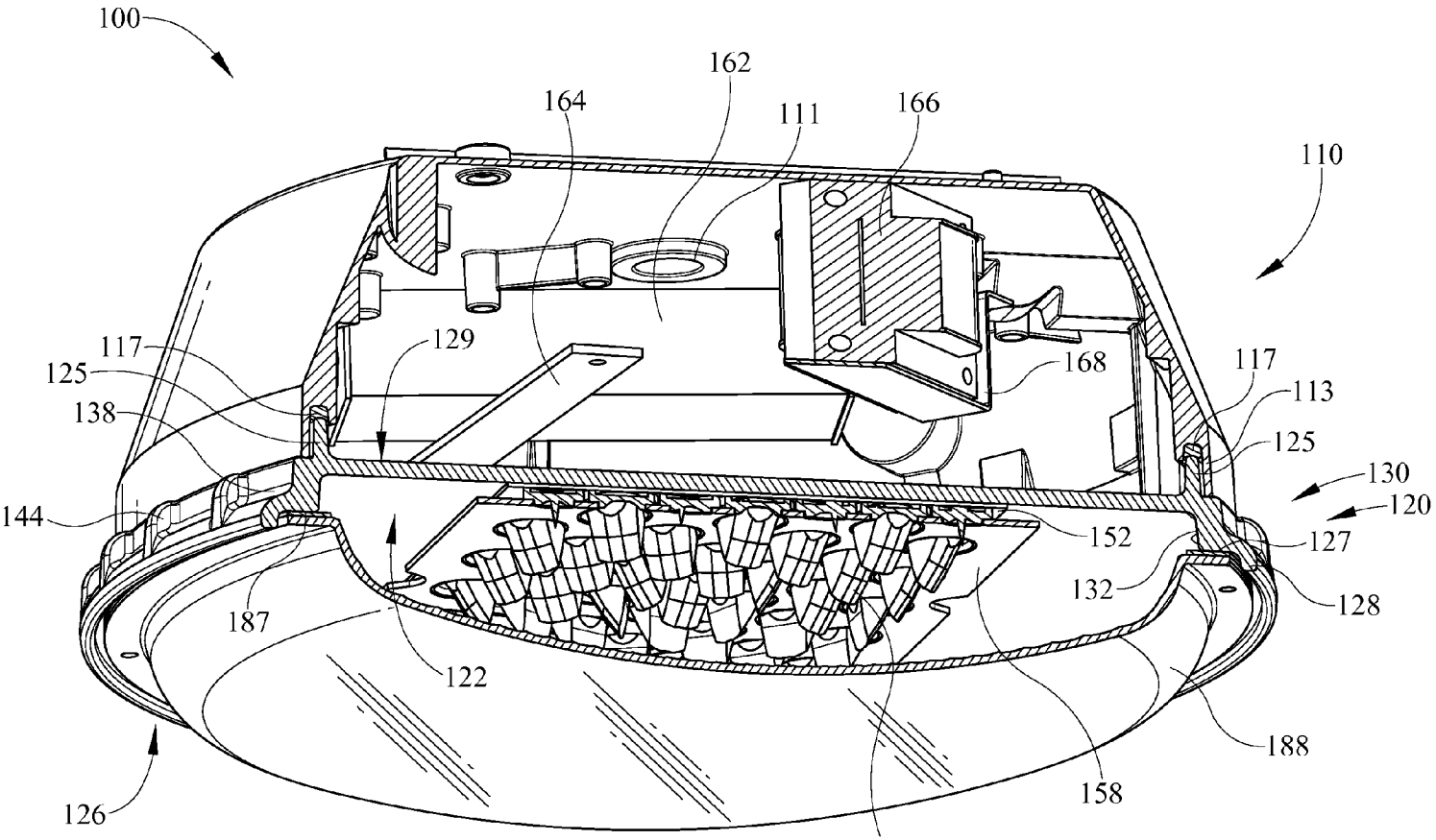
FIG. 2 is a side bottom perspective section view of the luminaire of FIG. 1 taken along the line 2-2 of FIG. 1.
Figure 3:
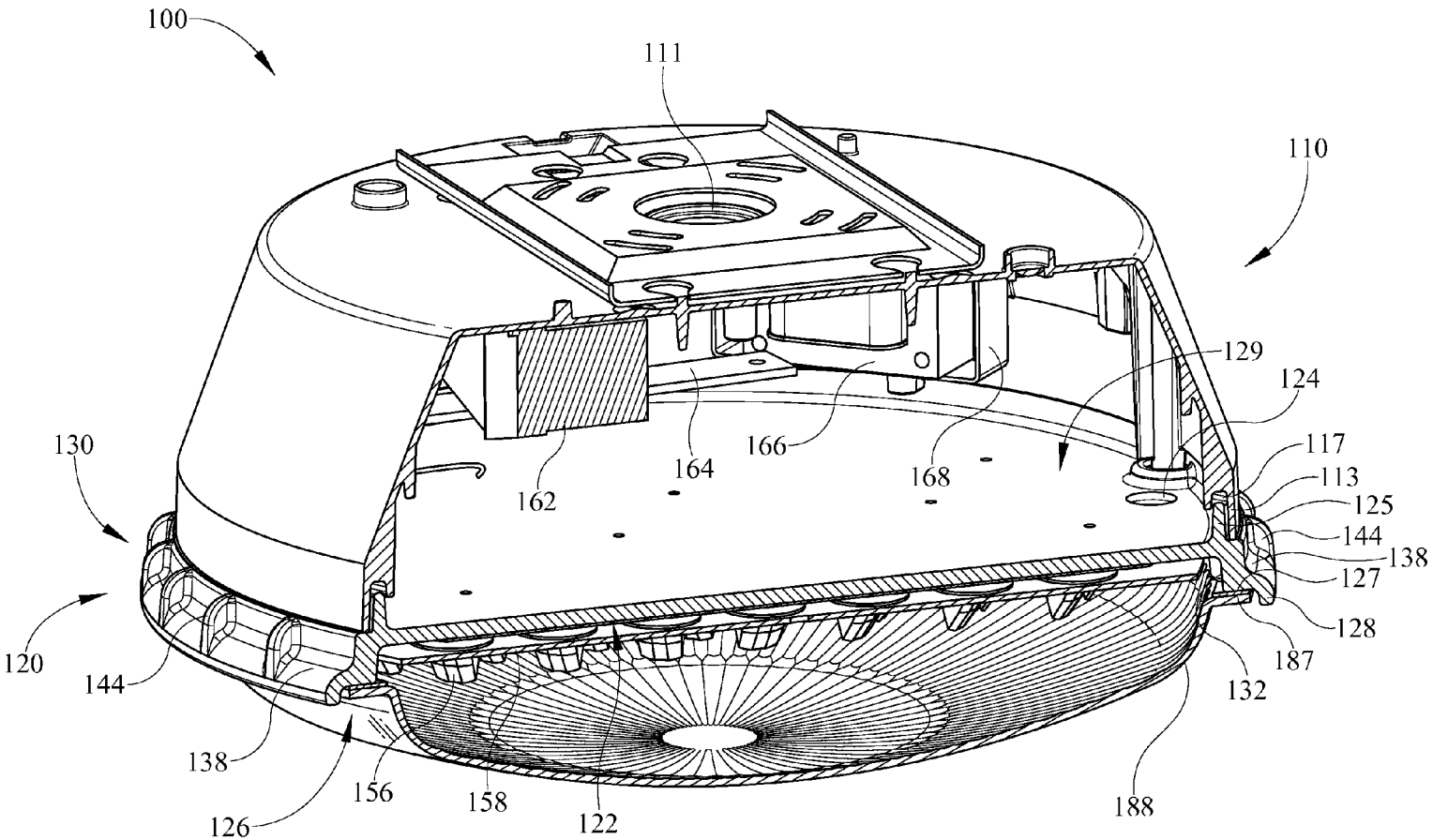
FIG. 3 is a side top perspective section view of the luminaire of FIG. 1 taken along the line 3-3 of FIG. 1.

Referring now to FIGS. 1 through 12, wherein like numerals refer to like parts, four separate embodiments of a luminaire having a lens frame with a LED support surface and heat dissipating structure are depicted. Referring initially to FIG. 1 through FIG. 3, a first embodiment of a luminaire 100 having a lens frame 120 with a LED support surface 122 and heat dissipating structure 130 is depicted. Luminaire 100 has a luminaire upper housing 110 with a bottom opening 112 generally outlined by a bottom opening lip 113. The luminaire 100 is configured to be attachable to a structure such as, for example, a ceiling within a parking garage, so that bottom opening 112 faces downwardly toward the area to be illuminated. A wire opening 111 is provided through an upper wall of the luminaire upper housing 110. Electrical wiring connected to an external power supply such as, for example, mains power, may extend through wire opening 111 and into the interior of luminaire 100.

The wiring connected to the mains power may be coupled to an input of a transformer 166 positioned toward the upper portion of the luminaire upper housing 110. The transformer 166 may be positioned toward the upper portion of the luminaire upper housing 110 by a coupling to a "U" shaped transformer bracket 168 coupled to the upper housing 110. In some embodiments the transformer 166 may be a Transfab Magnetic Solutions single phase transformer Model Number DLA9655SE having primary 277 Volt and 347 Volt input taps and a secondary 120 Volt output tap. The output of the transformer 166 may feed an LED driver 162 also positioned toward the upper portion of the upper luminaire housing 110. The LED driver 162 may be positioned toward the upper portion of the luminaire upper housing 110 by a coupling to a linearly shaped LED driver bracket 164 coupled to the upper housing 110. In some embodiments the LED driver may be a Magtech LP 1090-24-GG-170 having a 24 Volt 4 Amp output. In alternative embodiments the transformer 166 may be omitted and LED driver 162 may be configured to accept the mains power or other power being supplied to luminaire 100. In alternative embodiments transformer 166 and/or LED driver 162 may be configured to accept and/or output electricity having alternative characteristics such as, for example, alternative voltages, frequencies, and/or amperages.

A generally annular heat dissipating lens frame 120 may be coupled to luminaire upper housing 110. The heat dissipating lens frame 120 extends across and beyond bottom opening 112, closing the bottom opening 112 of the luminaire upper housing 110. The lens frame 120 includes a plurality of apertures 121 alignable with corresponding bosses 115 in luminaire upper housing 110. Fasteners may be inserted through apertures 121 and received in bosses 115 to secure lens frame 120 to top housing 110. When lens frame 120 is coupled to top housing 110 a lip 125 of lens frame 120 is interior to the top housing 110 and is immediately adjacent and surrounded by the bottom opening lip 113. A gasket 117 may optionally be provided interposed between a portion of lip 125 and upper housing portion 110. In some embodiments the lens frame 120 may be a single integrally formed piece. In some embodiments the construction material of the lens frame 120 may comprise aluminum.

The lens frame 120 has a recessed downward facing continuous support surface 122 that is generally annular in shape. Opposite the support surface 122 is a top surface 129 located interiorly of the luminaire 100. The top surface 129 is substantially flat and extends between the generally annular lip 125. The support surface 122 includes a plurality of LED board apertures 123 that receive fasteners used to couple an LED circuit board 152 to the support surface 122. In alternative embodiments LED circuit board 152 may be otherwise coupled to the support surface 122. For example, clips or other support structure may extend downwardly from support surface 122 and engage LED circuit board 152 and/or an adhesive may be used between support surface 122 and LED circuit board 152. In some embodiments the LED circuit board 152 may be a circuit board having desirable thermal characteristics. In some embodiments the LED circuit board 152 may be an aluminum core board produced by Trilogix Electronic Manufacturing. Optionally, a thermal compound may be interposed between the LED circuit board 152 and the support surface 122 if desired. In some embodiments a Graftech eGraf HT-1210 thermal interface material may be interposed between the LED circuit board 152 and the support surface 122. Electrical output from LED driver 162 may be supplied to LED circuit board 152. Electrical wiring coupled to the output of the LED driver 162 may extend through wire opening 124 and be coupled to LED circuit board 152. In some embodiments the wire opening 124 may be sealed with caulking after electrical wiring has been placed therethrough and/or may include a gasket for engaging any electrical wiring extending therethrough.

The LED circuit board 152 supports and supplies electrical power to a plurality of LEDs 154. In some embodiments fifty-four Cree XR-E LEDs 154 may be provided on the LED circuit board 152 and may be collectively powered with 96 Watts from the 24 Volt 4 Amp output from LED driver 162. In other embodiments forty-nine Lumiled Rebel LEDs may be provided. In alternative embodiments alternative LEDs 154 may be used. For example, one or more LEDs may be used that have alternative characteristics from the Lumiled Rebel LEDs depicted such as, for example, alternative lumen output, light distribution, color temperature and/or heat generating characteristics. An individual of a plurality of LED lenses 156 may be placed over each of the LEDs 154 and direct light output thereof. In some embodiments the LED lenses 156 may be Philips LifeLED optical lenses. A positioning plate 158 may be placed over the LED circuit board 152 to secure and/or to align the LED lenses 156 to a predetermined arrangement over the plurality of LEDs 154. The positioning plate 158 may have a plurality of apertures, each being configured to receive a single of LED lenses 156 and each having an alignment notch to mate with a corresponding alignment protrusion of each of LED lenses 156. In some embodiments the LED positioning plate 158 may align the LED lenses 156 to produce a predetermined optical output such as for example, an IES Type I, II, III, or IV distribution pattern. The positioning plate 158 may be adhered to the LED board 152 in some embodiments. In alternative embodiments alternative LED lenses may be used, including more than one type of LED lens in a single luminaire, and/or LED lenses may be omitted from a single, multiple, or all LEDs. For example, one or more optical pieces may be used that have alternative light distribution characteristics from the Philips LifLED optical lenses depicted.

The lens frame 120 also has a lens retaining area 126 positioned downward of and peripherally of the support surface 122. The lens retaining area 126 includes a lens attachment flange 127 surrounded by a lens attachment lip 128. The lens attachment flange 127 may engage a flange of a drop lens 188. Fasteners may be inserted through the flange of the drop lens 188 and received in corresponding apertures of the lens attachment flange 127 to removably couple the drop lens 188 to the lens attachment flange 127. In some embodiments a gasket 187 may be inserted between the flange of the drop lens 188 and the lens attachment flange 127. In some embodiments the gasket may be a medium density silicone rubber gasket. Although a lens retaining area 126 having a flange 127 surrounded by a lens attachment lip 128 has been described herein and shown in FIG. 1 through FIG. 3, it is understood that the lens retaining area 126 could vary from that shown. For example, in some embodiments lip 128 may be omitted. Also, for example, in some embodiment a lens retaining ring may be used to secure lens 188 to the lens retaining area 126.

The lens frame 120 also has heat dissipating structure 130 surrounding the support surface 122. The heat dissipating structure 130 includes a substantially vertical interior sidewall 132 that extends between the support surface 122 and the lens retaining area 126. The vertical interior sidewall 132 is located peripherally of the LEDs 152 and substantially in line with the periphery of the base of the upper housing 110. The heat dissipating structure 130 also includes a substantially "L" shaped exterior sidewall 138 located exteriorly of the top housing 110 and extending from adjacent the top surface 129 to adjacent the lens retaining area 126. A plurality of vertically oriented arcuate heat fins 144 extend outward from the exterior sidewall 138. The exterior sidewall 138 and the heat fins 144 are directly exposed to the external environment when the luminaire 100 is installed. The heat dissipating structure 130 may help minimize or prevent icicle build up on the luminaire 100 in colder environments.

The support surface 122, the heat dissipating structure 130, and the drop lens 188 surround the LEDs 154, forming a substantially sealed chamber for the LEDs 154. Some of the heat generated by the circuit board 152 and LEDs 154 may be absorbed by the support surface 122 and dissipated outwardly toward the heat dissipating structure 130. The heat dissipating structure 130 may dissipate some of the heat to the external environment. The LED driver 162 and the transformer 166 are spaced apart from lens frame 120 thereby minimizing heat transfer between lens frame 120 and transformer 166 and LED driver 162.

Figure 4:
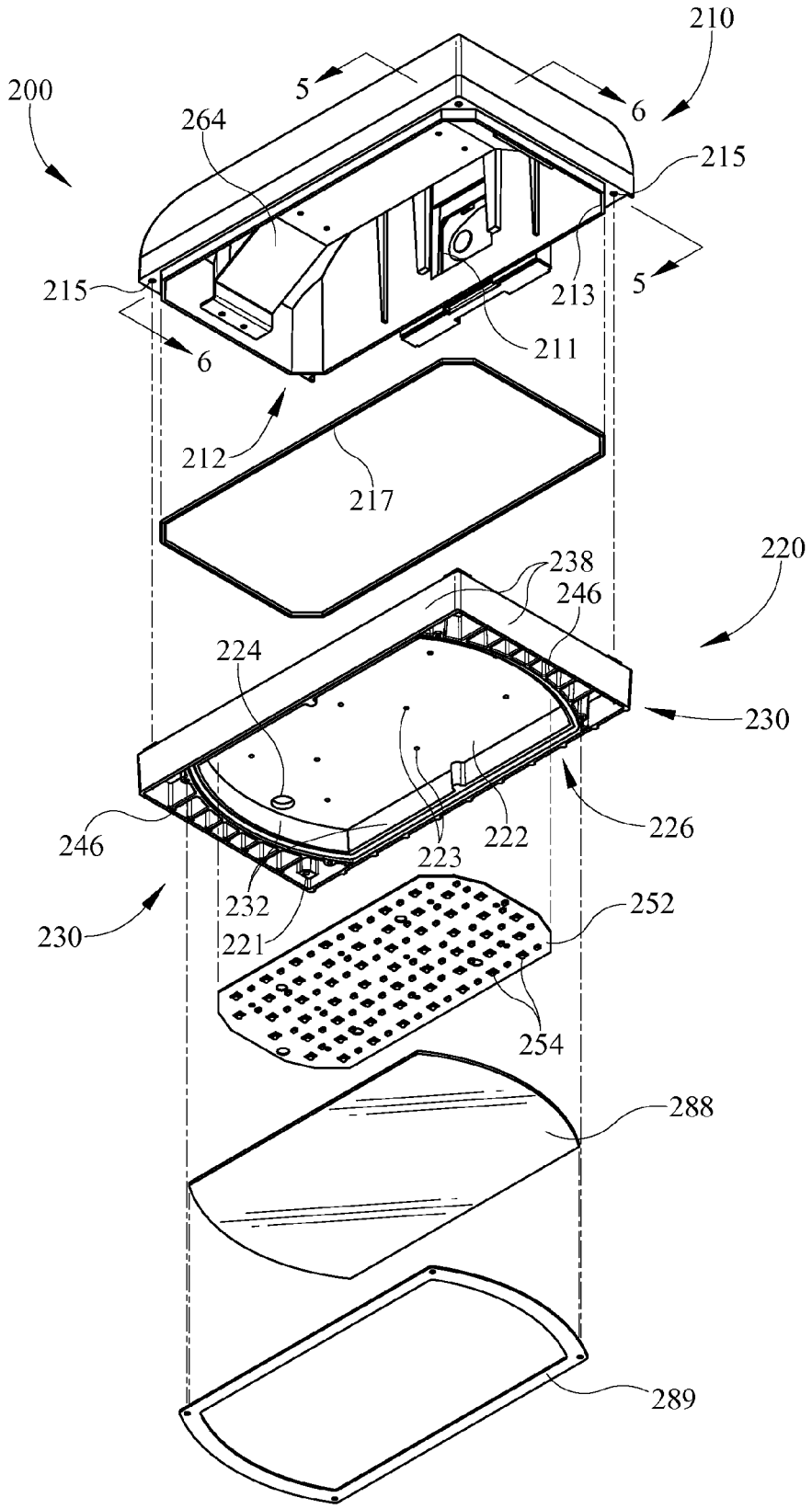
FIG. 4 is a bottom exploded perspective view of a second embodiment of a luminaire having a lens frame with a LED support surface and heat dissipating structure.
Figure 5:
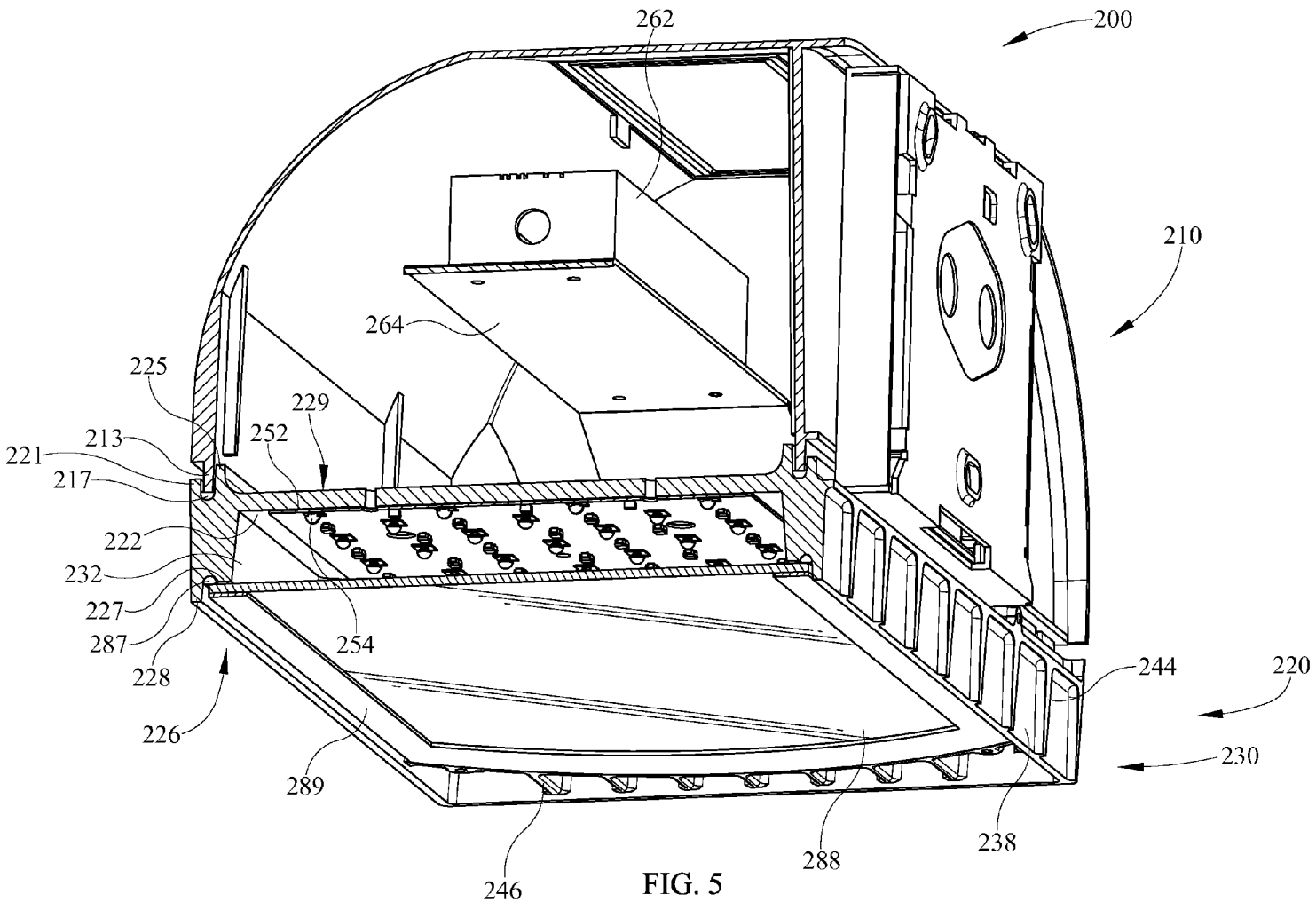
FIG. 5 is a side bottom perspective section view of the luminaire of FIG. 4 taken along the line 5-5 of FIG. 4.
Figure 6:
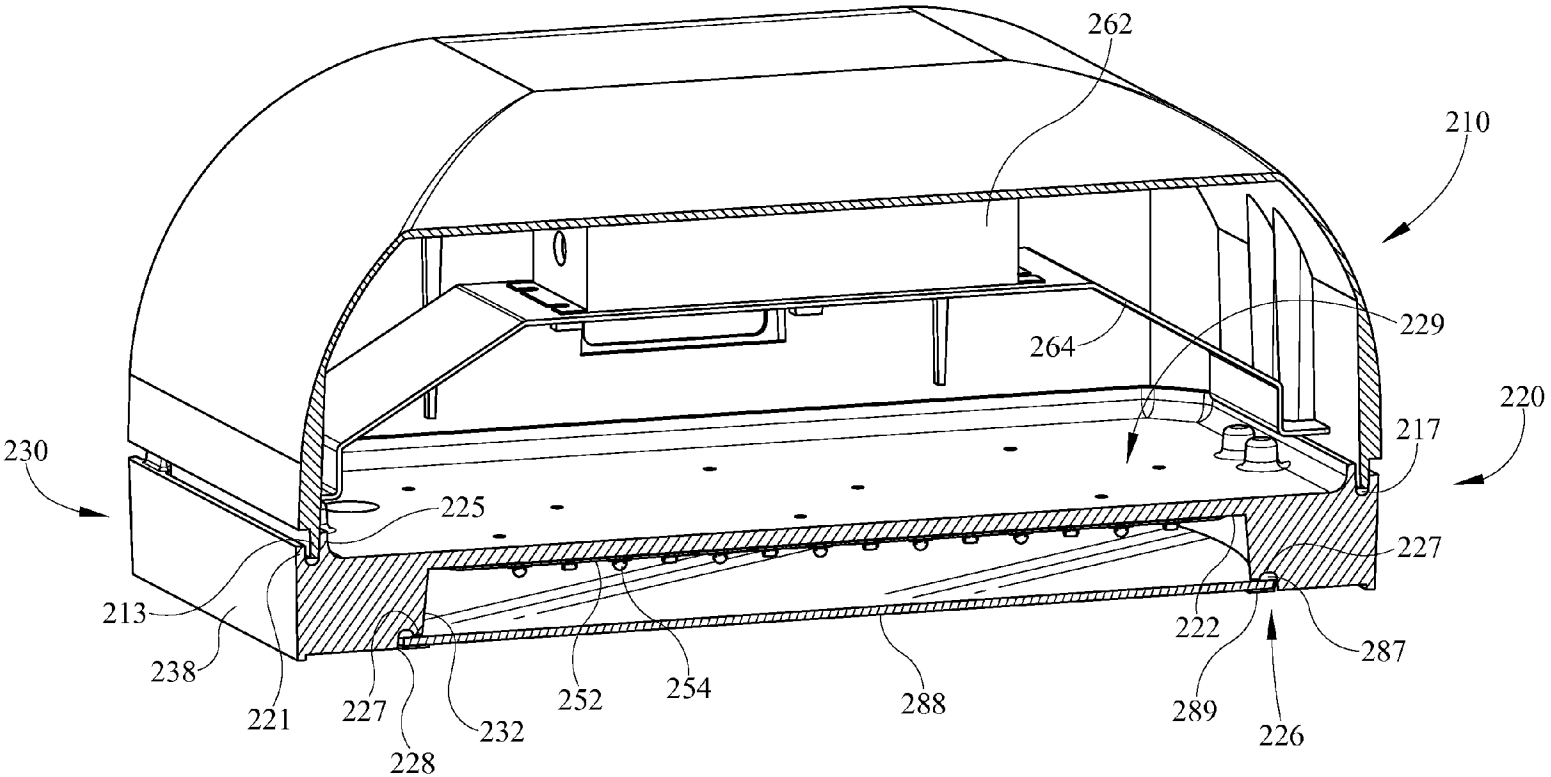
FIG. 6 is a side top perspective section view of the luminaire of FIG. 4 taken along the line 6-6 of FIG. 5.

Referring now to FIGS. 4 through 6, a second embodiment of a luminaire 200 having a lens frame 220 with a LED support surface 222 and heat dissipating structure 230 is depicted. Luminaire 200 has a luminaire upper housing 210 with a downward facing bottom opening 212 generally outlined by a bottom opening lip 213. The luminaire 200 is configured to be attachable to and extend outwardly from a structure such as, for example, a wall, so that bottom opening 212 faces downwardly and somewhat outwardly toward the area to be illuminated. A wire opening 211 for electrical wiring from an external power supply is provided through a side wall of the luminaire upper housing 210.

The electrical wiring connected to the external power supply may be coupled to an input of a LED driver 262 positioned toward the upper portion of the upper luminaire housing 210. The LED driver 262 may be positioned toward the upper portion of the luminaire upper housing 210 by a coupling to a pyramidal LED driver bracket 264 coupled to the sides of the upper housing 210. No transformer is provided in the second embodiment as the LED driver 262 is configured to accept the voltage of the external power supply.

A generally rectangular continuous heat dissipating lens frame 220 may be coupled to luminaire upper housing 210. The heat dissipating lens frame 220 extends across and beyond bottom opening 212, closing the bottom opening 212 of the luminaire upper housing 210. The lens frame 220 includes a plurality of bosses 221 proximal corners thereof that are alignable with corresponding apertures 215 proximal corners of luminaire upper housing 210. Fasteners may be inserted through bosses 221 and received in the apertures 215 to secure lens frame 220 to top housing 210. When lens frame 220 is coupled to top housing 210 a lip 225 of the lens frame 220 is interior to the top housing 210 and is immediately adjacent and surrounded by the bottom opening lip 213. A smaller lip 221 of the lens frame 220 is exterior to the top housing 210 and is immediately adjacent and surrounded by the bottom opening lip 213. A gasket 217 may optionally be provided interposed between lip 225 and lip 221 and adjacent lip 213.

The lens frame 220 has a recessed downward facing support surface 222. Opposite the support surface 222 is a top surface 229 located interiorly of the luminaire 200. The top surface 229 is substantially flat and extends between the generally rectangular lip 225. The support surface 222 includes a plurality of LED board bosses 223 that receive fasteners used to couple an LED circuit board 252 to the support surface 222. In alternative embodiments LED circuit board 252 may be otherwise coupled to the support surface 222. Optionally, a thermal compound may be interposed between the LED circuit board 252 and the support surface 222. Electrical output from LED driver 262 may be supplied to LED circuit board 252. Electrical wiring coupled to the output of the LED driver 262 may extend through wire opening 224 and be coupled to LED circuit board 252. The LED circuit board 252 supports and supplies electrical power to a plurality of LEDs 254. The LEDs 254 of the second embodiment are not each paired with a corresponding optical lens. In alternative embodiments each of the LEDs 254 may be paired with a corresponding Philips LifeLed optical lens.

The lens frame 220 also has a lens retaining area 226 positioned downward of and peripherally of the support surface 222. The lens retaining area 226 includes a lens attachment flange 227 with a gasket notch therein receiving a gasket 217. Lens attachment flange 227 is surrounded by a lens attachment lip 228. The lens attachment flange 227 may engage a periphery of a flat lens 288. A lens ring 289 may be removably secured to lens frame 220, thereby trapping the periphery of lens 288 between the lens ring 289 and lens attachment flange 227.

The lens frame 220 also has heat dissipating structure 230 surrounding the support surface 222. The heat dissipating structure 230 includes a substantially vertical interior sidewall 232 that extends between the support surface 222 and the lens retaining area 226. The vertical interior sidewall 232 is located peripherally of the LEDs 252. The heat dissipating structure 230 also includes an exterior sidewall 238 that is substantially vertical and flat on three sides thereof. A rear surface of the exterior sidewall, which would be adjacent a wall or other mounting surface when luminaire 200 is installed and which is visible in FIG. 5, has a plurality of small vertically oriented heat fins 244 extending therefrom. A plurality of vertically oriented heat fins 246 are provided in each of two downwardly facing troughs located on shorter latitudinal ends of lens frame 220 extending in a longitudinal direction from adjacent the interior sidewall 232 to adjacent the exterior sidewall 238 on lens frame 220. The heat dissipating structure 230 may help minimize or prevent icicle build up on the luminaire 200 in colder environments.

The support surface 222, the heat dissipating structure 230, and the flat lens 288 surround the LED board 252 and LEDs 254 forming a substantially sealed chamber for the LEDs 254. Some of the heat generated by the circuit board 252 and LEDs 254 may be absorbed by the support surface 222 and dissipated outwardly toward the heat dissipating structure 230. The heat dissipating structure 230 may dissipate some of the heat to the external environment. The LED driver 262 is spaced apart from lens frame 220 thereby minimizing heat transfer between lens frame 220 and LED driver 262.

Figure 7:
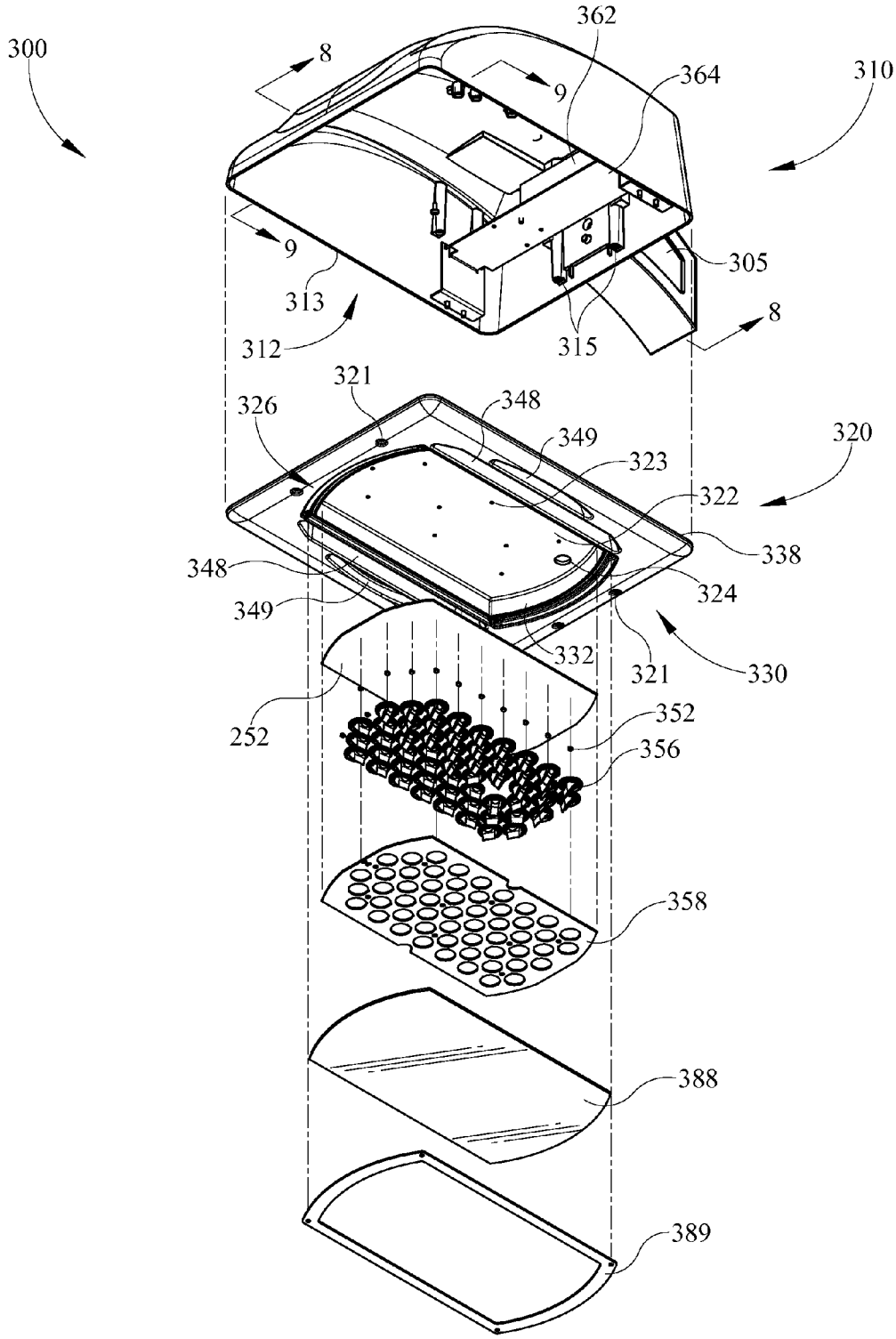
FIG. 7 is a bottom exploded perspective view of a third embodiment of a luminaire having a lens frame with a LED support surface and heat dissipating structure.
Figure 8:
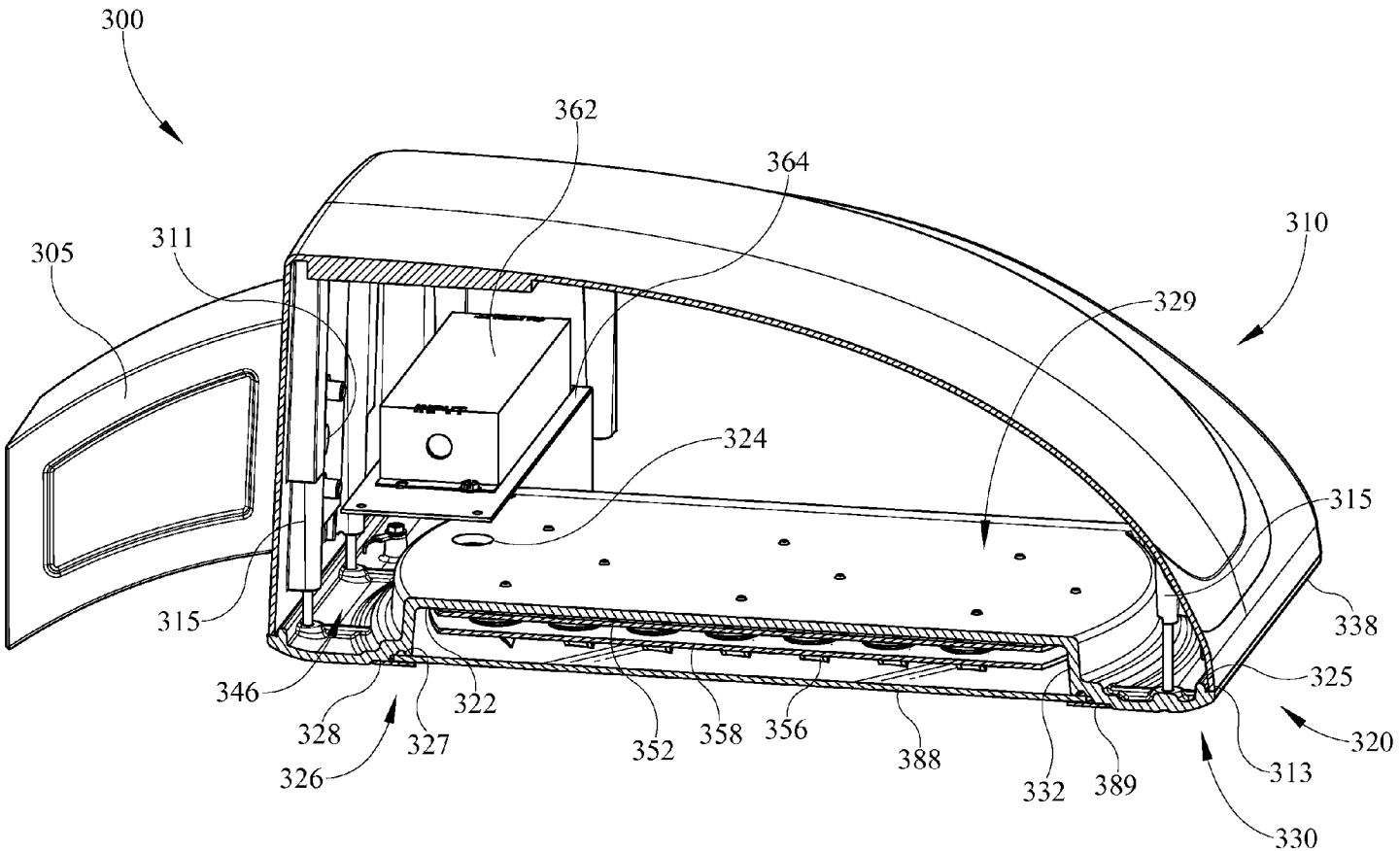
FIG. 8 is a side bottom perspective section view of the luminaire of FIG. 7 taken along the line 8-8 of FIG. 7.
Figure 9:
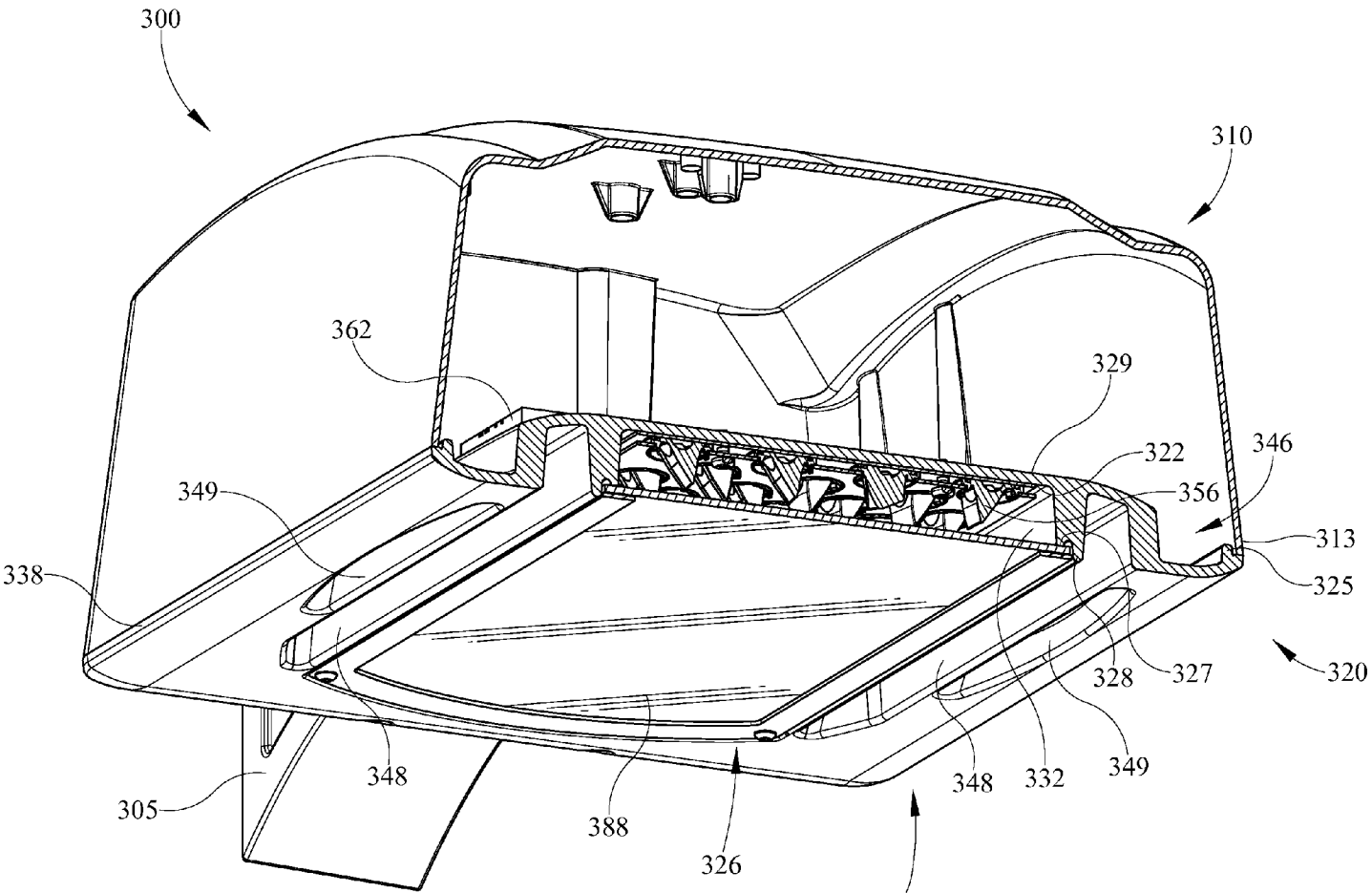
FIG. 9 is a side top perspective section view of the luminaire of FIG. 7 taken along the line 9-9 of FIG. 7.

Referring now to FIGS. 7 through 9, a third embodiment of a luminaire 300 having a lens frame 320 with a LED support surface 322 and heat dissipating structure 330 is depicted. Luminaire 300 has a luminaire upper housing 310 with a generally rectangular bottom opening 312 generally outlined by a bottom opening lip 313. The luminaire 300 is configured to be attachable to and extend outwardly from a structure such as, for example, attached to a support pole via a support arm 305, so that opening 312 faces downwardly toward the area to be illuminated. A wire opening 311 for electrical wiring from an external power supply is provided through a rear wall of the luminaire upper housing 310.

The electrical wiring connected to the external power supply may be coupled to an input of a LED driver 362 positioned toward the upper portion of the upper luminaire housing 310. The LED driver 362 may be positioned toward the upper portion of the luminaire upper housing 310 by a coupling to a linear LED driver bracket 364 coupleable to a heat dissipating lens frame 320. No transformer is provided in the second embodiment as the LED driver 362 is configured to accept the voltage of the external power supply.

The heat dissipating lens frame 320 is generally rectangular with rounded edges and may be coupled to luminaire upper housing 310. The heat dissipating lens frame 320 extends across and closes the bottom opening 312 of the luminaire upper housing 310. The periphery of the lens frame 320 is substantially flush with the periphery of the upper housing 310. The lens frame 320 includes a plurality of apertures 321 alignable with corresponding bosses 315 in luminaire upper housing 310. Fasteners may be inserted through apertures 321 and received in bosses 315 to secure lens frame 320 to top housing 310. When lens frame 320 is coupled to top housing 310 a lip 325 is interior to the top housing 310 and is immediately adjacent and surrounded by the bottom opening lip 313.

The lens frame 320 has a recessed downward facing support surface 322. Opposite the support surface 322 is a top surface 329 located interiorly of the luminaire 300. The top surface 329 is substantially flat where it runs between the interior sidewall 332, then drops off into a trough 346 that surrounds the sidewall 332 and extends between the sidewall 332 and the lip 325. The support surface 322 includes a plurality of LED board bosses 323 that receive fasteners used to couple an LED circuit board 352 to the support surface 322. In alternative embodiments LED circuit board 352 may be otherwise coupled to the support surface 322. Optionally, a thermal compound may be interposed between the LED circuit board 352 and the support surface 322. Electrical output from LED driver 362 may be supplied to LED circuit board 352. Electrical wiring coupled to the output of the LED driver 362 may extend through wire opening 324 and be coupled to LED circuit board 352. The LED circuit board 352 supports and supplies electrical power to a plurality of LEDs 354, each having a corresponding optical lens 356 aligned and secured to LED circuit board 352 by a positioning plate 356.

The lens frame 320 also has a lens retaining area 326 positioned downward of and peripherally of the support surface 322. The lens retaining area 326 includes a lens attachment flange 327 surrounded by a lens attachment lip 328. The lens attachment flange 327 may engage a periphery of a flat lens 388. A lens ring 389 may be removably secured to lens frame 320, thereby trapping the periphery of lens 388 between the lens ring 389 and lens attachment flange 327. A gasket may be inserted between the flange of the lens 388 and the lens attachment flange 327.

The lens frame 320 also has heat dissipating structure 330 surrounding the support surface 322. The heat dissipating structure 330 includes a substantially vertical interior sidewall 332 that extends between the support surface 322 and the lens retaining area 326. The vertical interior sidewall 332 is located peripherally of the LEDs 352. The heat dissipating structure 330 also includes a relatively thin exterior sidewall 338 that is slightly chamfered. A longitudinally extending first trough 348 and a longitudinally extending second trough 349 flank the support surface 322. The first trough 348 is of a greater length than the second trough 349 and both the first trough 348 and the second trough 349 are generally downward facing and are directly exposed to the external environment when the luminaire 300 is installed. The first trough 348 and the second trough 349 are located between the interior sidewall 332 and the exterior sidewall 338. The top surface 329 may extend upwardly into trough 346 where the second trough 349 is located. The heat dissipating structure 330 is substantially planar with the top housing 310 and may help minimize or prevent icicle build up on the luminaire 300 in colder environments.

The support surface 322, the heat dissipating structure 330, and the flat lens 388 surround the LED board 352 and LEDs 354 forming a substantially sealed chamber for the LEDs 354. Some of the heat generated by the circuit board 352 and LEDs 354 may be absorbed by the support surface 322 and dissipated outwardly toward the heat dissipating structure 330. The heat dissipating structure 330 may dissipate some of the heat to the external environment. The LED driver 362 is spaced apart from lens frame 320 thereby minimizing heat transfer between lens frame 320 and LED driver 362.

Figure 10:
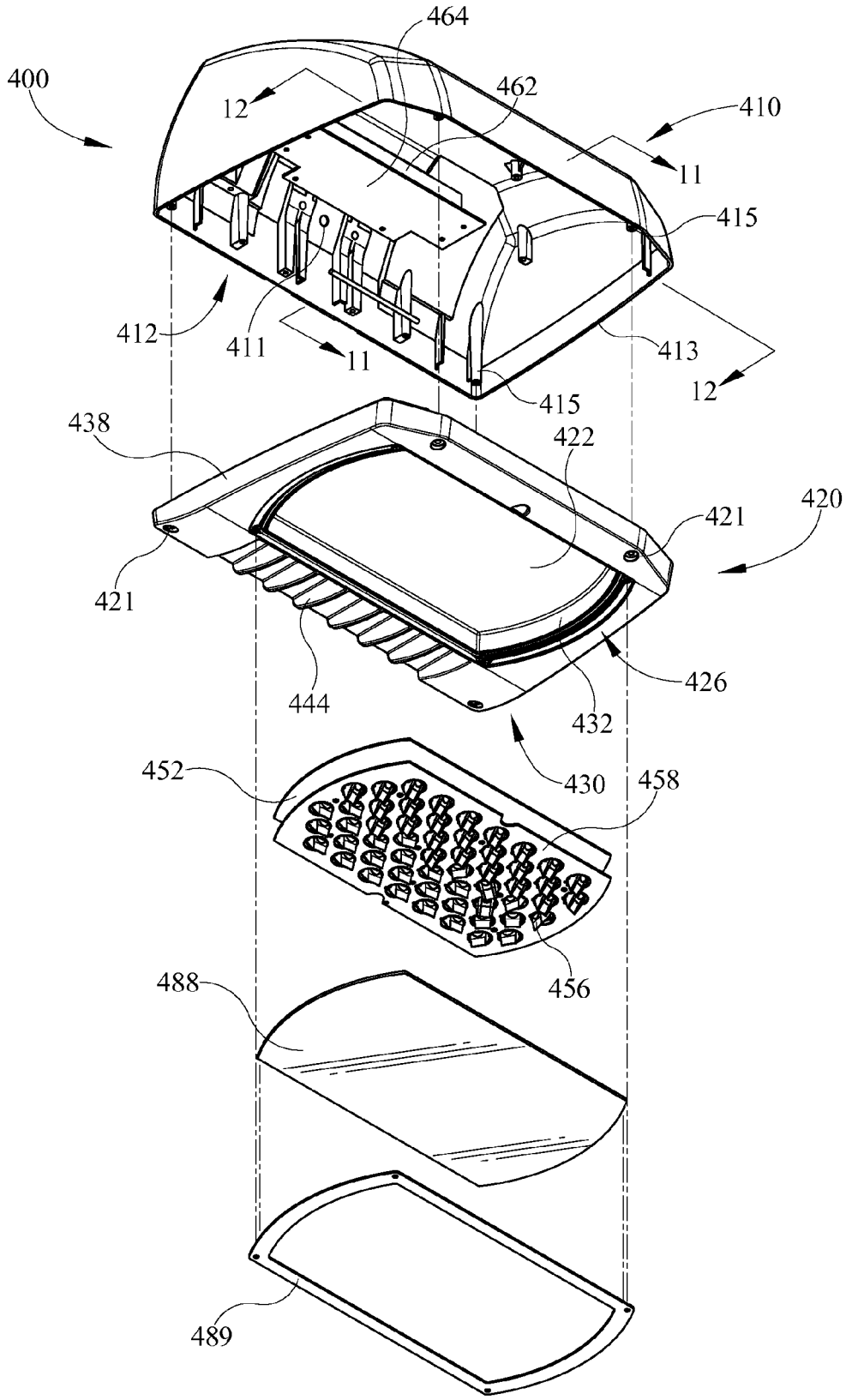
FIG. 10 is a bottom exploded perspective view of a fourth embodiment of a luminaire having a lens frame with a LED support surface and heat dissipating structure.
Figure 11:
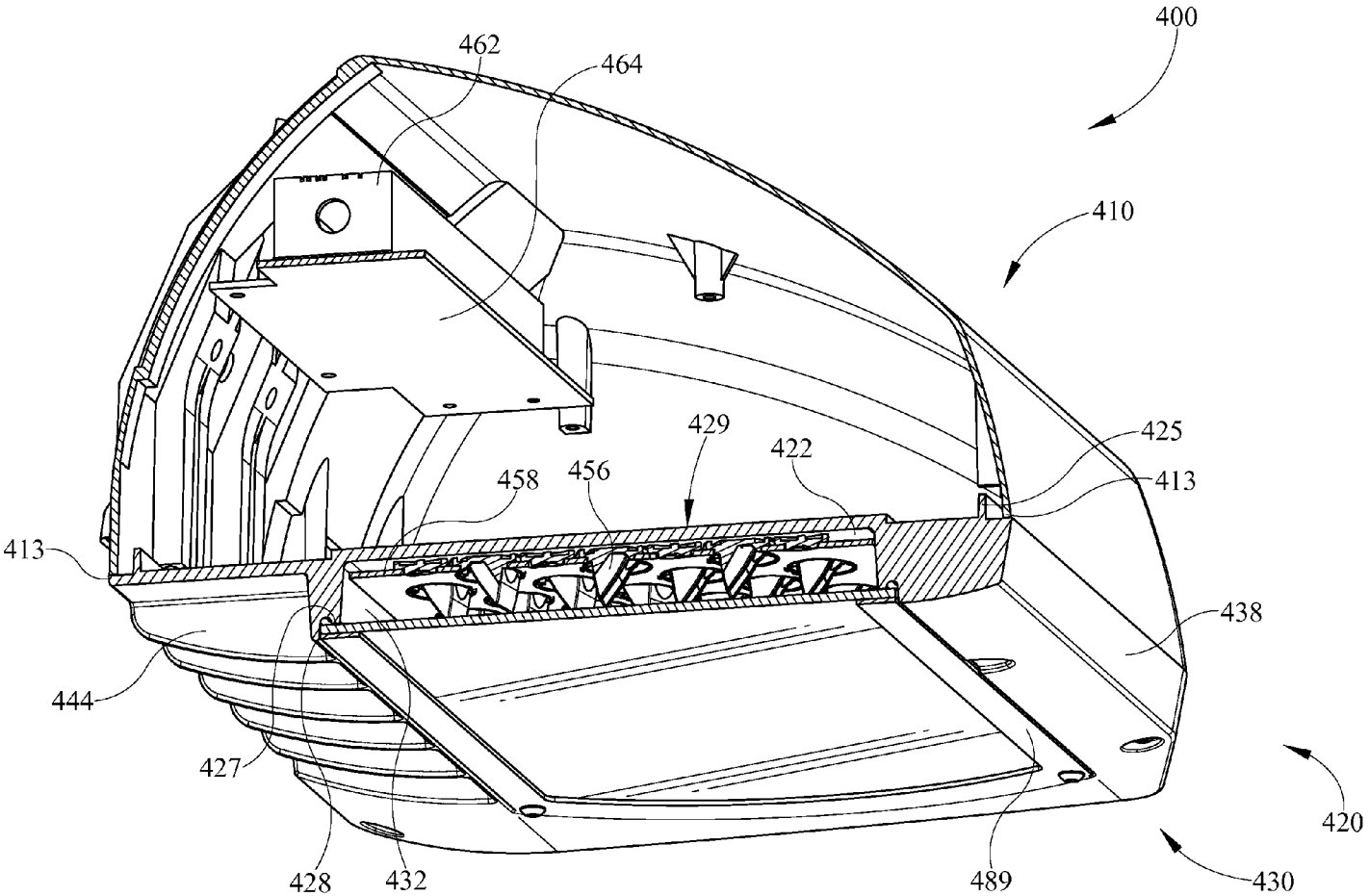
FIG. 11 is a side bottom perspective section view of the luminaire of FIG. 10 taken along the line 11-11 of FIG. 10.
Figure 12:
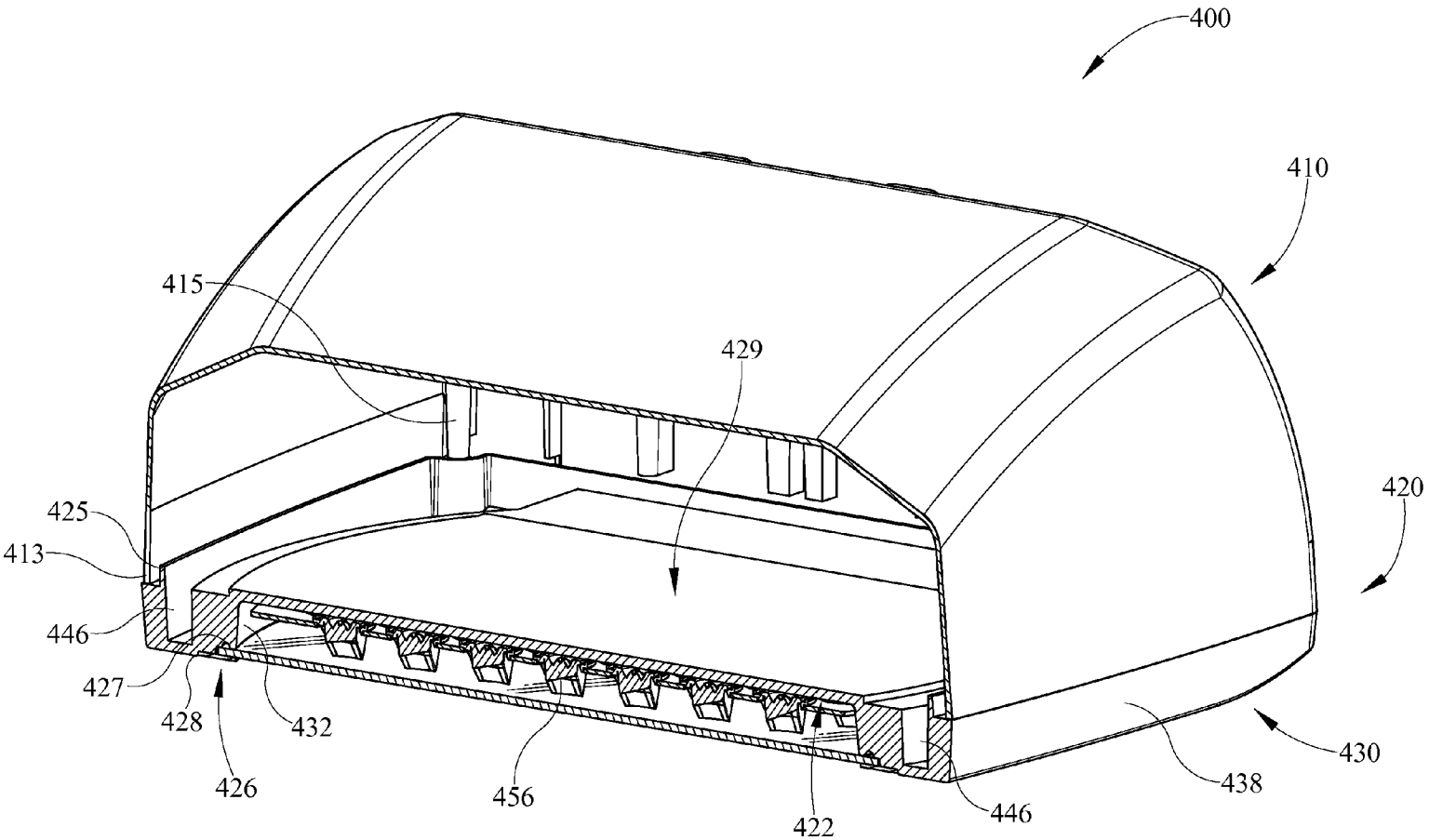
FIG. 12 is a side top perspective section view of the luminaire of FIG. 10 taken along the line 12-12 of FIG. 10.

Referring now to FIGS. 10 through 12, a fourth embodiment of a luminaire 400 having a lens frame 420 with a LED support surface 422 and heat dissipating structure 430 is depicted. Luminaire 400 has a luminaire upper housing 410 with a generally rectangular opening 412 generally outlined by an opening lip 413. The luminaire 400 is configured to be attachable to and extend outwardly at a forward tilt angle from a structure such as, for example, a wall, so that bottom opening 412 faces generally downwardly and outwardly toward the area to be illuminated. A wire opening 411 for electrical wiring from an external power supply is provided through a rear wall of the luminaire upper housing 410.

The wiring connected to the external power supply may be coupled to an input of a LED driver 462 positioned toward the upper portion of the upper luminaire housing 410. The LED driver 462 may be positioned toward the upper portion of the luminaire upper housing 410 by a coupling to a linearly extending LED driver bracket 464 coupled to the rear of the upper housing 410. No transformer is provided in the fourth embodiment as the LED driver 462 is configured to accept the voltage of the external power supply.

A heat dissipating lens frame 420 may be coupled to luminaire upper housing 410. The heat dissipating lens frame 420 extends across and closes the bottom opening 412 of the luminaire upper housing 410. The periphery of the lens frame 420 is substantially aligned with the periphery of the upper housing 410. The lens frame 420 includes a plurality of apertures 421 alignable with corresponding bosses 415 in luminaire upper housing 410. Fasteners may be inserted through apertures 421 and received in bosses 415 to secure lens frame 420 to top housing 410. When lens frame 420 is coupled to top housing 410 a lip 425 is interior to the top housing 410 and is immediately adjacent and surrounded by the bottom opening lip 413.

The lens frame 420 has a continuous recessed downward facing support surface 422. The support surface 422 is generally rectangular with curved ends provided on two shorter latitudinal ends thereof. Opposite the support surface 422 is a top surface 429 located interiorly of the luminaire 400. An LED circuit board 452 may be coupled to the support surface 422 using, for example, an adhesive. In alternative embodiments LED circuit board 452 may be otherwise coupled to the support surface 422. Optionally, a thermal compound may be interposed between the LED circuit board 452 and the support surface 422. Electrical output from LED driver 462 may be supplied to LED circuit board 452. Electrical wiring coupled to the output of the LED driver 462 may extend through a wire opening extending through lens frame 420 and be coupled to LED circuit board 452. The LED circuit board 452 supports and supplies electrical power to a plurality of LEDs 454, each having a corresponding optical lens 456 aligned and secured to LED circuit board 452 by a positioning plate 456. In some embodiments the plurality of LEDs 454 may each be provided without a corresponding optical lens 456.

The lens frame 420 also has a lens retaining area 426 positioned downward of and peripherally of the support surface 422. The lens retaining area 426 includes a lens attachment flange 427 surrounded by a lens attachment lip 428. The lens attachment flange 427 may engage a periphery of a flat lens 488. A lens ring 489 may be removably secured to lens frame 420, thereby trapping the periphery of lens 488 between the lens ring 489 and lens attachment flange 427. A gasket may be inserted between the flange of the lens 488 and the lens attachment flange 427.

The lens frame 420 also has heat dissipating structure 430 surrounding the support surface 422. The heat dissipating structure 430 includes a substantially vertical interior sidewall 432 that extends between the support surface 422 and the lens retaining area 426. The vertical interior sidewall 432 is located peripherally of the LEDs 452. The heat dissipating structure 430 also includes an exterior sidewall 438. A plurality of vertically extending heat fins 444 are provided on a rear portion of the lens frame 420 and extend from proximal the rear longitudinal portion of the interior sidewall 432 to proximal the rear longitudinal portion of the exterior sidewall 438. An interior trough 446 is present in the upper surface 429, surrounds the support surface 422 and is located between the interior sidewall 442 and the exterior sidewall 448. The interior trough 446 is generally upward facing and is not directly exposed to the external environment when the luminaire 400 is installed. The heat dissipating structure 430 may help minimize or prevent icicle build up on the luminaire 400 in colder environments.

The support surface 422, the heat dissipating structure 430, and the flat lens 488 surround the LED board 452 and LEDs 454 forming a substantially sealed chamber for the LEDs 454. Some of the heat generated by the circuit board 452 and LEDs 454 may be absorbed by the support surface 422 and dissipated outwardly toward the heat dissipating structure 430. The heat dissipating structure 430 may dissipate some of the heat to the external environment. The LED driver 462 is spaced apart from lens frame 420 thereby minimizing heat transfer between lens frame 420 and LED driver 462.

Figure 13:
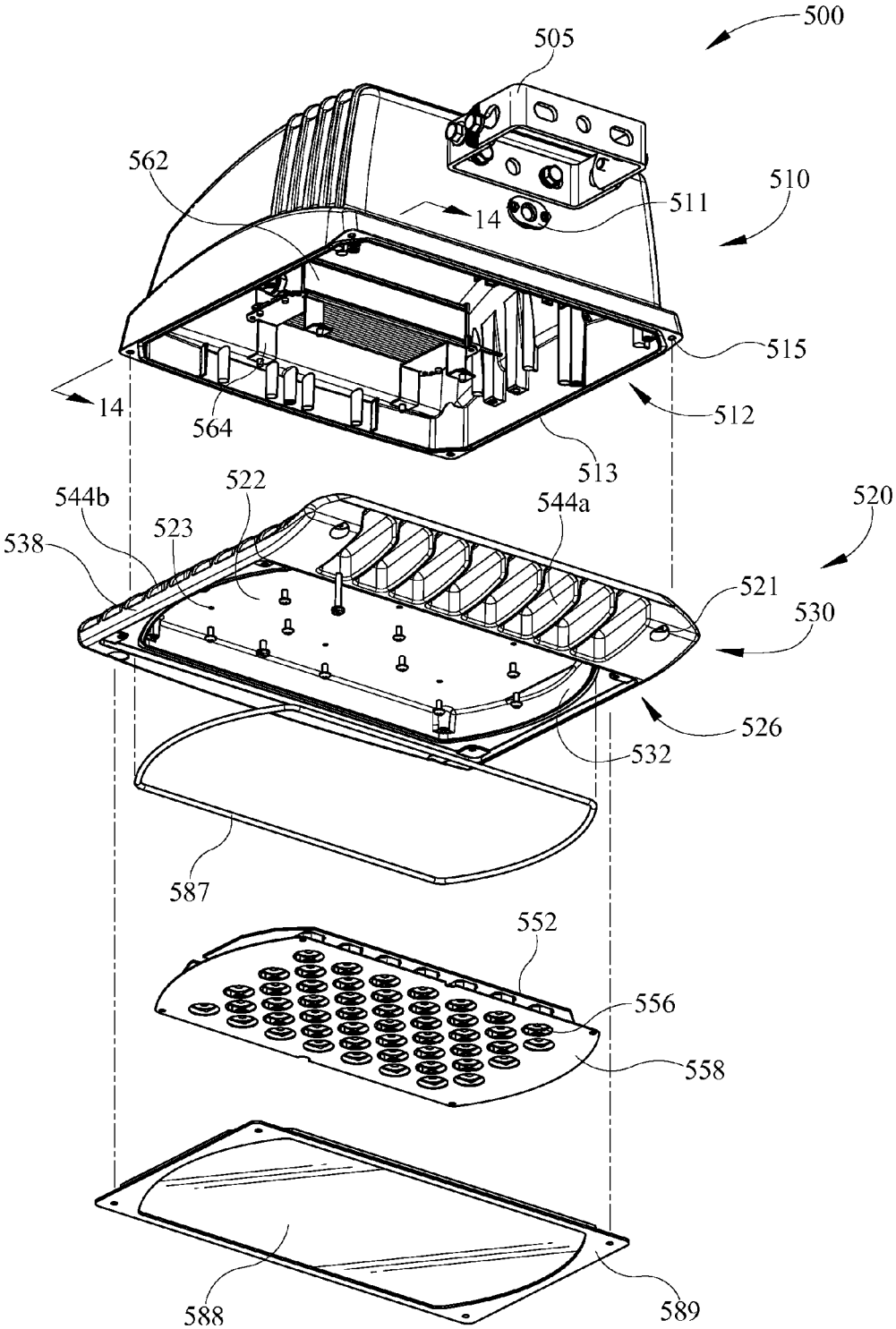
FIG. 13 is a bottom exploded perspective view of a fifth embodiment of a luminaire having a lens frame with a LED support surface and heat dissipating structure.
Figure 14:
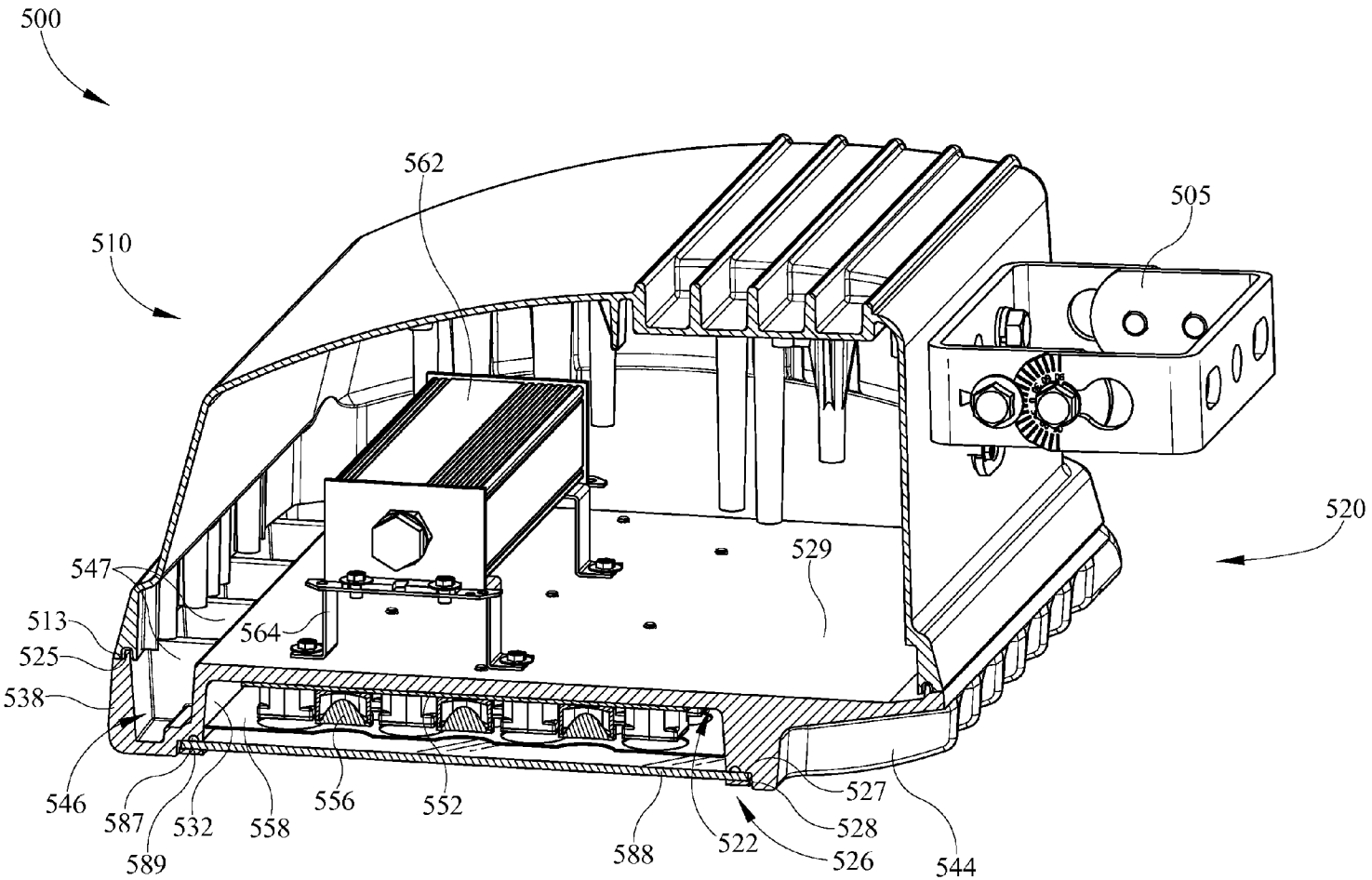
FIG. 14 is a side top perspective section view of the luminaire of FIG. 13 taken along the line 14-14 of FIG. 13.

Referring now to FIGS. 13 and 14, a fifth embodiment of a luminaire 500 having a lens frame 520 with a LED support surface 522 and heat dissipating structure 530 is depicted. Luminaire 500 has a luminaire upper housing 510 with a generally rectangular opening 512 generally outlined by an opening lip 513. The luminaire 500 is configured for floodlighting applications, so that opening 512 faces generally toward an area to be illuminated, such as, for example, a side of a building or other structure. A support bracket 505 may be attached to a structure such as, for example, a corresponding bracket affixed to the ground. A wire opening 511 for electrical wiring from an external power supply is provided through a rear wall of the luminaire upper housing 510.

The wiring connected to the external power supply may be coupled to an input of a LED driver 562 positioned within the upper luminaire housing 510 and offset from the lens frame 520. The LED driver 562 is offset from the lens frame 520 by a coupling to a pair of "U" shaped LED driver brackets 564 coupled to the rear surface 529 of the of the lens frame 520. No transformer is provided in the fifth embodiment as the LED driver 562 is configured to accept the voltage of the external power supply.

The heat dissipating lens frame 520 is coupled to luminaire upper housing 510 and extends across and closes the opening 512 of the luminaire upper housing 510. The front and rear longitudinal portions of the periphery of the lens frame 520 are substantially aligned with the periphery of the upper housing 510. The left and right shorter latitudinal portions of the periphery of the lens frame 520 extend beyond the periphery of the upper housing 510. The lens frame 520 includes a plurality of apertures 521 alignable with corresponding bosses 515 in luminaire upper housing 510. Fasteners may be inserted through apertures 521 and received in bosses 515 to secure lens frame 520 to top housing 510. When lens frame 520 is coupled to top housing 510 a lip 525 is interior to the top housing 510 and is immediately adjacent and surrounded by the bottom opening lip 513 of the upper housing 510. The lip 525 engages a gasket 587 within a notch partially formed by lip 513.

The lens frame 520 has a continuous recessed support surface 522. The support surface 522 is generally rectangular with curved ends provided on two shorter latitudinal ends thereof. An LED circuit board 552 may be coupled to the support surface 522 using, for example, one or more fasteners extending through LED circuit board 552 and received in apertures 523. Electrical output from LED driver 562 may be supplied to LED circuit board 552. The LED circuit board 552 supports and supplies electrical power to a plurality of LEDs each having a corresponding optical lens 556 aligned and secured to LED circuit board 552 via an adhesive. In some embodiments each optical lens 556 may be a LEDIL RES SQUARE LENS model # FA10853_RES-SS. An aluminum plate 558 having a plurality of openings for allowing a plurality of optical lens 556 to pass therethrough and/or to allow light exiting optical lenses 556 to pass therethrough. Aluminum plate 558 may be positioned over the LED circuit board 552 for aesthetic, optical, and/or heat management purposes. The aluminum plate 558 is depicted offset from the LED circuit board 552 in FIGS. 13 and 14, but may alternately be contacting the LED circuit board 552.

The lens frame 520 also has a lens retaining area 526 positioned outward from and peripherally of the support surface 522. The lens retaining area 526 includes a lens attachment flange 527 surrounded by a lens attachment lip 528. The lens attachment flange 527 may engage a periphery of a flat lens 588. A lens ring 589 may be removably secured to lens frame 520, thereby trapping the periphery of lens 588 between the lens ring 589 and lens attachment flange 527. A gasket 587 may be inserted between the lens 588 and the lens attachment flange 527.

The lens frame 520 also has heat dissipating structure 530 surrounding the support surface 522. The heat dissipating structure 530 includes a substantially vertical interior sidewall 532 that extends between the support surface 522 and the lens retaining area 526. The vertical interior sidewall 532 is located peripherally of the LED circuit board 552. The heat dissipating structure 530 also includes an exterior sidewall 538. A plurality of vertically extending heat fins **544*a* are provided on a rear portion of the lens frame 520 and extend from proximal the rear longitudinal portion of the interior sidewall 532 to proximal the rear longitudinal portion of the exterior sidewall 538. An interior trough 546 is present in the forward longitudinal portion of the lens frame 520, adjacent the support surface 522 and is located between the interior sidewall 532 and the exterior sidewall 538. The interior trough 546 is generally Upward facing and is not directly exposed to the external environment when the luminaire 500 is installed. The interior trough 546 has a plurality of heat fins 547 extending transversely therethrough from adjacent the interior sidewall 532 to adjacent the exterior sidewall 538. A plurality of vertically oriented arcuate heat fins 544*b* are also provided on each latitudinal portion of the lens frame 520. The heat fins 544*b* extend outward from the exterior sidewall 538 and extends beyond the periphery of the upper housing 510. The exterior sidewall 538 and the heat fins 544*a* and 544*b* are directly exposed to the external environment when the luminaire 500** is installed.

The support surface 522, the heat dissipating structure 530, and the flat lens 588 surround the LED board 552 and LEDs 554 forming a substantially sealed chamber for the LEDs 554. Some of the heat generated by the circuit board 552 and LEDs 554 may be absorbed by the support surface 522 and dissipated outwardly toward the heat dissipating structure 530.

The heat dissipating structure 530 may dissipate some of the heat to the external environment. The LED driver 562 is spaced apart from lens frame 520 thereby minimizing heat transfer between lens frame 520 and LED driver 562.

Figure 15:
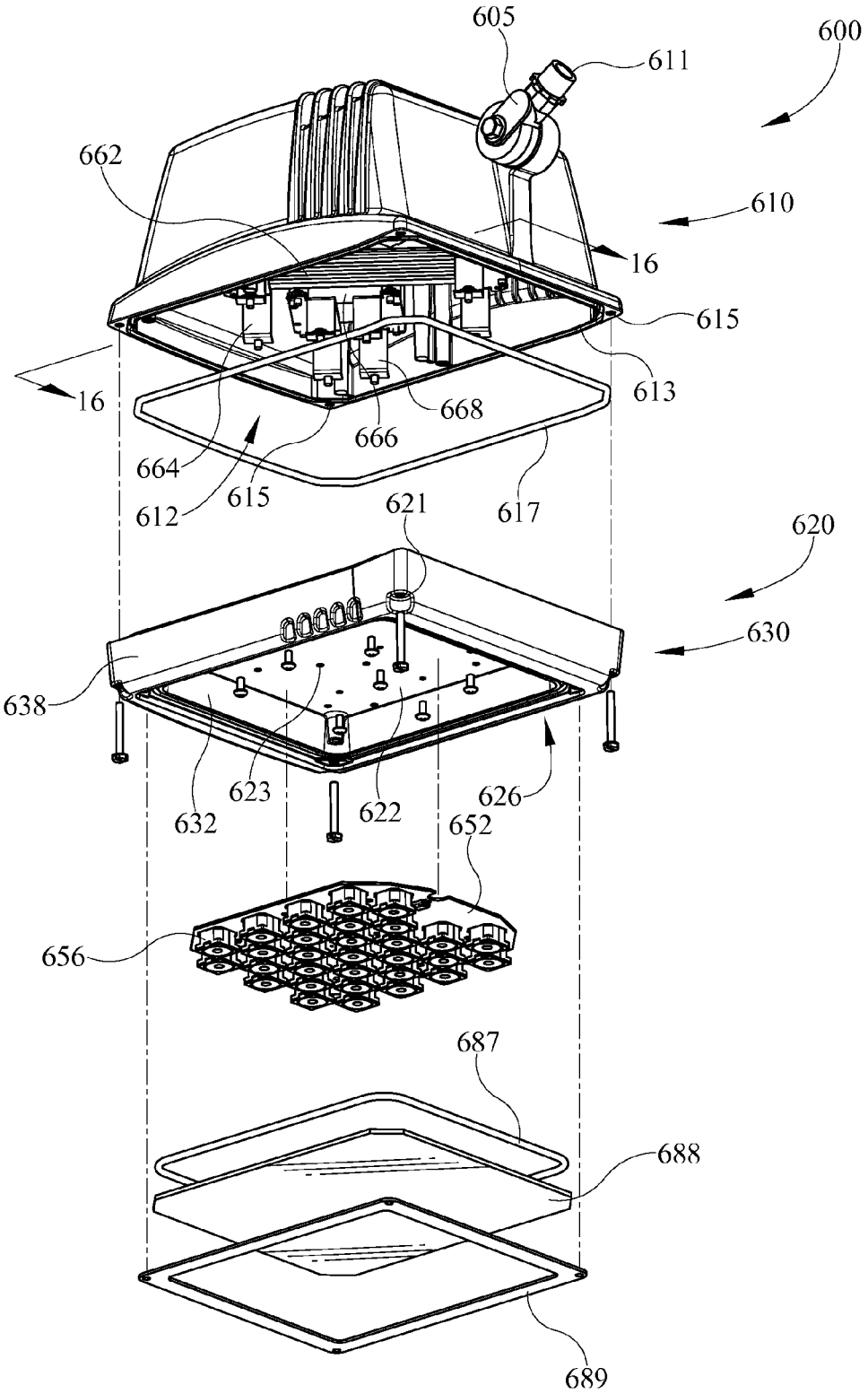
FIG. 15 is a bottom exploded perspective view of a sixth embodiment of a luminaire having a lens frame with a LED support surface and heat dissipating structure.
Figure 16:
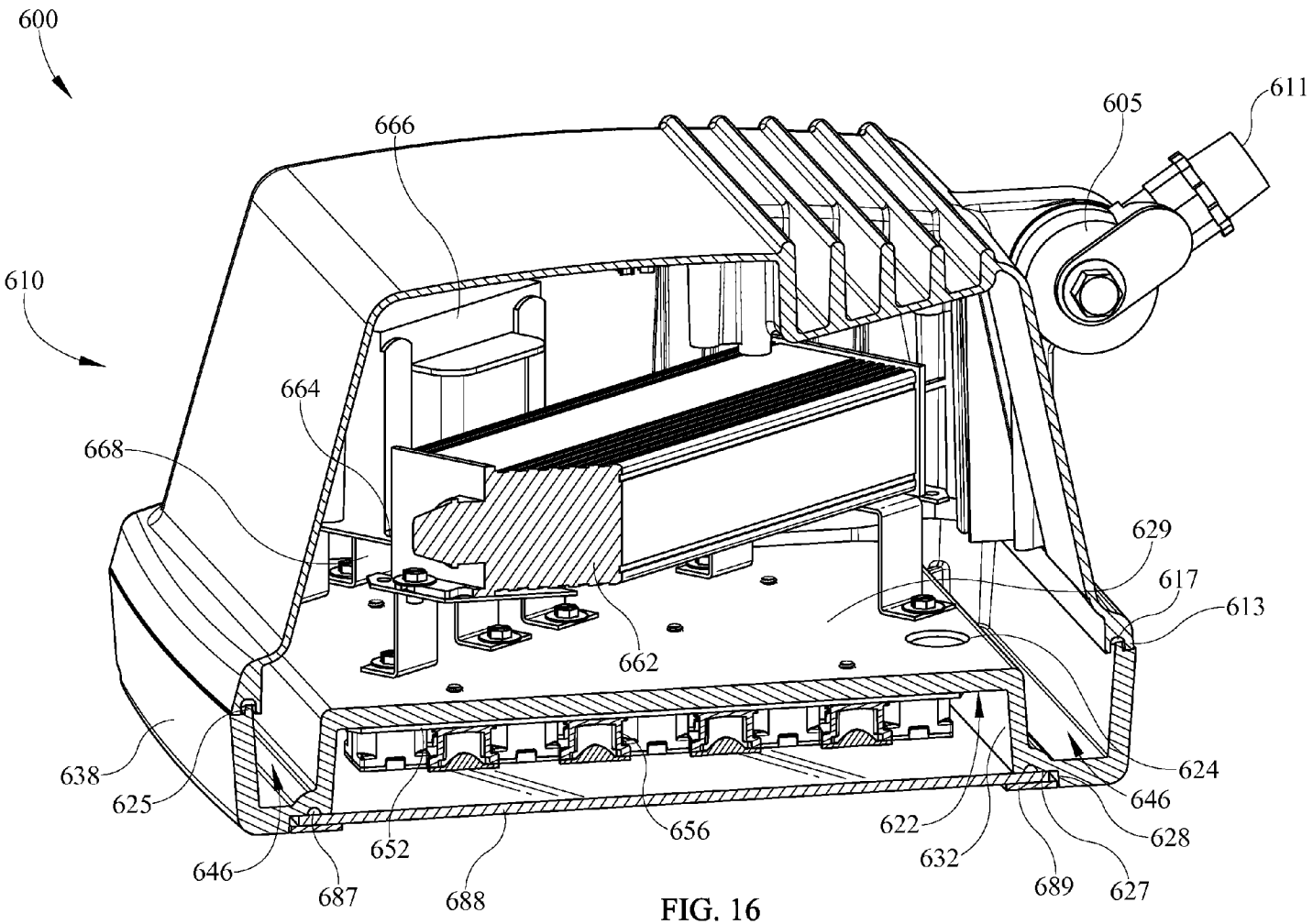
FIG. 16 is a side top perspective section view of the luminaire of FIG. 15 taken along the line 16-16 of FIG. 15.

Referring now to FIGS. 15 and 16, a sixth embodiment of a luminaire 600 having a lens frame 620 with a LED support surface 622 and heat dissipating structure 630 is depicted. Luminaire 600 has a luminaire upper housing 610 with a generally square opening 612 generally outlined by an opening lip 613. The luminaire 600 is configured for floodlighting applications, so that opening 612 faces generally toward an area to be illuminated, such as, for example, a side of a building or other structure. A support arm 605 may be attached to a structure such as, for example, a corresponding support pole. A wire opening 611 for electrical wiring from an external power supply is provided through the support arm 605.

The wiring connected to the external power supply may be coupled to an input of a transformer 666 offset from the lens frame 620. The transformer 666 may be positioned offset from the lens frame 620 by a coupling to a pair of "U" shaped transformer brackets 668 coupled to the rear surface 629 of the lens frame 620. Electrical output from the transformer 666 is coupled to an input of a LED driver 662 positioned within the upper luminaire housing 610 and offset from the lens frame 620. The LED driver 662 is offset from the lens frame 620 by a coupling to a pair of "U" shaped LED driver brackets 664 coupled to the rear surface 629 of the of the lens frame 620. Electrical wiring coupled to the output of the LED driver 662 may extend through wire opening 624 and be coupled to LED circuit board 652.

The heat dissipating lens frame 620 is coupled to the luminaire upper housing 610 and extends across and closes the opening 612 of the luminaire upper housing 610. The periphery of the lens frame 620 is substantially aligned with the periphery of the upper housing 610. The lens frame 620 includes a plurality of apertures 621 alignable with corresponding bosses 615 in luminaire upper housing 610. Fasteners may be inserted through apertures 621 and received in bosses 615 to secure lens frame 620 to top housing 610. When lens frame 620 is coupled to top housing 610 a lip 625 is interior to the top housing 610 and is immediately adjacent and surrounded by the opening lip 613. The lip 625 engages a gasket 617 within a notch partially formed by lip 613.

The lens frame 620 has a continuous recessed support surface 622. The support surface 622 is generally square with curved corners. An LED circuit board 652 may be coupled to the support surface 622 using, for example, one or more fasteners extending through LED circuit board 652 and received in apertures 623. Electrical output from LED driver 662 may be supplied to LED circuit board 652. The LED circuit board 652 supports and supplies electrical power to a plurality of LEDs each having a corresponding optical lens 656 aligned and secured to LED circuit board 652 via an adhesive. An aluminum plate that may be positioned over the LED circuit board for aesthetic, optical, and/or heat management purposes is not provided in the embodiment of FIGS. 15 and 16.

The lens frame 620 also has a lens retaining area 626 positioned outward from and peripherally of the support surface 622. The lens retaining area 626 includes a lens attachment flange 627 surrounded by a lens attachment lip 628. The lens attachment flange 627 may engage a periphery of a flat lens 688. A lens ring 689 may be removably secured to lens frame 620, thereby trapping the periphery of lens 688 between the lens ring 689 and lens attachment flange 627. The gasket 687 may be inserted between the lens 688 and the lens attachment flange 627.

The lens frame 620 also has heat dissipating structure 630 surrounding the support surface 622. The heat dissipating structure 630 includes a substantially vertical interior sidewall 632 that extends between the support surface 622 and the lens retaining area 626. The vertical interior sidewall 632 is located peripherally of the LED circuit board 652. The heat dissipating structure 630 also includes an exterior sidewall 638 that is substantially vertical all the way along the periphery and is of a similar height as interior sidewall 632. An interior trough 646 is present peripherally of the support surface 622 on the side of the lens frame 620 that is adjacent the support arm 605 and is also present peripherally of the support surface 622 on the side of the lens frame 620 that is opposite the support arm 605. The interior trough 646 is generally upward facing, extends between interior sidewall 632 and exterior sidewall 638, and is not directly exposed to the external environment when the luminaire 600 is installed.

The support surface 622, the heat dissipating structure 630, and the flat lens 688 surround the LED board 652 and LEDs 654 forming a substantially sealed chamber for the LEDs 654. Some of the heat generated by the circuit board 652 and LEDs 654 may be absorbed by the support surface 622 and dissipated outwardly toward the heat dissipating structure 630. The heat dissipating structure 630 may dissipate some of the heat to the external environment. The LED driver 662 and transformer 666 are spaced apart from lens frame 620 thereby minimizing heat transfer between lens frame 620 and LED driver 662 and transformer 666.

The foregoing description has been presented for purposes of illustration. It is not intended to be exhaustive or to limit the invention to the precise forms disclosed, and obviously many modifications and variations are possible in light of the above teaching. It is understood that while certain forms of the invention have been illustrated and described, it is not limited thereto except insofar as such limitations are included in the following claims and allowable functional equivalents thereof.

We claim:

1. A retrofit heat dissipating lens frame for attachment to a luminaire housing having a luminaire housing opening, the lens frame comprising: a continuous support surface (122) supporting an LED board (152) having a plurality of LEDs (154) coupled thereto, said continuous support surface generally facing an illumination direction; a lens attachment flange (127) integrally formed with a heat dissipating structure (130) and offset away from said support surface (122) generally in said illumination direction; a lens, attached to said lens attachment flange; wherein said lens (188), and said support surface (122) form a substantially sealed chamber for said plurality of LEDs (154); wherein said heat dissipating lens frame (120) is sized to completely cover said opening (112) of said luminaire housing (110) when attached to said luminaire housing (110); and wherein said support surface (122) having a partially exposed portion to the external environment when said lens frame (120) is attached to said luminaire housing (110) wherein said support surface (122) is of a sufficient mass to dissipate heat from an LED board (152).

2. The heat dissipating lens frame of claim 1, wherein said support surface (122) includes a plurality of heat fins (144) located peripherally of said LED support surface (122).

3. The heat dissipating lens frame of claim 2, wherein said plurality of heat fins (144) are located peripherally of said luminaire housing (110) when said lens frame (120) is attached to said luminaire housing (110).

4. The heat dissipating lens frame of claim 2, wherein said plurality of heat fins (144) are vertically oriented and extend from adjacent a support surface plane generally defined by said support surface (122) to adjacent a lens attachment plane generally defined by said lens attachment flange (127).

5. The heat dissipating lens frame of claim 1, wherein said support surface (122) includes a vertically oriented sidewall (132) around the periphery of said lens (188).

6. The heat dissipating lens frame of claim 5, wherein said support surface (122) includes at least one trough between said sidewall (132) and the periphery of said heat dissipating lens frame.

7. The heat dissipating lens frame of claim 6, wherein said at least one trough is generally upward facing and is not directly exposed to the external environment when said lens frame (120) is attached to said luminaire housing (110).

8. The heat dissipating lens frame of claim 6, wherein said at least one trough is generally facing in said illumination direction and is directly exposed to the external environment when said lens frame (120) is attached to said luminaire housing (110).

9. A luminaire with a lens frame for mounting and cooling LEDs, the luminaire comprising: a luminaire housing (110) having an opening (112); a continuous lens frame (120) extending across and closing said opening (112) of said luminaire housing (110); said lens frame (120) comprising a recessed support surface (122) generally facing an illumination direction, a lens retaining area (126) positioned peripherally of said support surface (122) and outward and away from said support surface (122) and said luminaire housing (110); a plurality of LEDs (154) coupled to said support surface (122) of said lens frame (120) exteriorly of said luminaire housing (110); a lens (188) coupled to said lens retaining area (126); wherein said support surface (122), and said lens (128) enclose said LEDs (154); and an LED driver (162) located interiorly of said housing (110) remote from said lens frame (120), wherein said support surface (122) having a partially exposed portion to the external environment and said support surface (122) is of a sufficient mass to dissipate heat from an LED board (152).

10. The heat dissipating lens frame of claim 9, wherein said support surface (122) includes a plurality of vertically oriented heat fins (144) extending from adjacent a support surface plane generally defined by a side opposite said illumination direction of said support surface (122) to adjacent a lens attachment plane generally defined by said lens retaining area (126).

11. The luminaire of claim 10, wherein said heat fins (144) extend peripherally of said luminaire housing (110).

12. The luminaire of claim 10, wherein said heat fins (144) are flanked by sidewalls of a heat dissipating structure.

13. The heat dissipating lens frame of claim 12, wherein said sidewalls include at least a portion of a vertically oriented sidewall (132) extending between said LED support surface and said lens.

14. The heat dissipating lens frame of claim 9, wherein said support surface (122) includes at least one trough around the periphery of said heat dissipating lens frame (120).

15. The heat dissipating lens frame of claim 14, wherein said at least one trough is located interiorly of said luminaire (100).

16. The heat dissipating lens frame of claim 14, wherein said at least one trough is generally facing away from said luminaire housing (110) and exposed to the external environment.

17. An LED luminaire, comprising: a housing (110) having an opening (112);

an LED driver (162) surrounded by said housing (110); a lens frame (120) contacting said housing (110) and extending completely across said opening (112) of said housing (110), said lens frame (120) comprising a support surface (122), a lens retaining area (126) positioned outward and away from said support surface (122), wherein said lens retaining area (126), and said support surface (122), are all formed as an integral piece; an LED board (152) coupled to said support surface (122), said LED board (152) having a plurality of LEDs (154) outputting a directed light output, said LEDs (152) electrically connected to said LED driver (162); a lens (188) coupled to said lens retaining area (126); wherein said lens (188), and said LED support surface (122), form a chamber enclosing said plurality of LEDs (154); wherein said support surface (122) having a partially exposed portion to the external environment and said support surface (122) is of a sufficient mass to dissipate heat from said LED board (152) and wherein said LED driver (162) is mounted within said housing (110) non-adjacent to said lens frame (120).

18. The LED luminaire of claim 17, wherein LED luminaire includes at least one vertically oriented wall (132) extending from a periphery of said support surface (122) toward said lens retaining area (126).

19. The LED luminaire of claim 18, wherein a lens retaining ring couples said lens to said lens retaining area (126).

* * * * *